US005993572A

United States Patent [19]

Saito et al.

[11] Patent Number: 5,993,572

[45] Date of Patent: Nov. 30, 1999

[54] THIXOCASTING PROCESS, AND THIXOCASTING ALUMINUM ALLOY MATERIAL

[75] Inventors: Nobuhiro Saito; Haruo Shiina; Takeyoshi Nakamura; Takeshi Sugawara; Kazuo Kikawa, all of Saitama, Japan

[73] Assignee: Honda Giken Kogyo Kabushiki Kaisha, Tokyo, Japan

[21] Appl. No.: 08/728,435

[22] Filed: Oct. 9, 1996

[30] Foreign Application Priority Data

| | | | |
|---|---|---|---|
| Oct. 9, 1995 | [JP] | Japan | 7-288071 |
| Oct. 12, 1995 | [JP] | Japan | 7-290489 |
| Nov. 1, 1995 | [JP] | Japan | 7-308175 |
| Dec. 19, 1995 | [JP] | Japan | 7-348890 |

[51] Int. Cl.[6] ..... C22C 21/00

[52] U.S. Cl. ..... 148/440; 148/437; 148/688; 420/544; 420/542; 420/528; 420/548

[58] Field of Search ..... 420/544, 542, 420/528, 548; 148/440, 437, 688

[56] References Cited

U.S. PATENT DOCUMENTS

| | | | |
|---|---|---|---|
| 3,031,299 | 4/1962 | Criner | 420/535 |
| 3,926,690 | 12/1975 | Morris et al. | 148/440 |
| 5,178,686 | 6/1993 | Schmid et al. | 148/439 |

FOREIGN PATENT DOCUMENTS

572683A1 12/1993 European Pat. Off. ..... B22D 17/00

*Primary Examiner*—Patrick Ryan
*Assistant Examiner*—M. Alexandra Elve
*Attorney, Agent, or Firm*—Lyon & Lyon LLP

[57] ABSTRACT

In a thixocasting process, the following steps are used: a step of subjecting, to a heating treatment, an Al-Si based alloy material having a hypo eutectic crystal composition and a characteristic that a first angled endothermic section appearing due to the melting of a eutectic crystal and a second angled endothermic section appearing due to the melting of a component having a melting point higher than a eutectic point exist in a differential calorimetric curve, thereby preparing a semi-molten Al-Si based alloy material having solid and liquid phases coexisting therein; a step of pouring the semi-molten Al-Si based alloy material into a cavity in a casting mold under pressure; and a step of solidifying the semi-molten Al-Si based alloy material under pressure. When the temperature of a rise-start point in the first angled endothermic section is represented by $T_1$, and the temperature of a drop-end point the first angled endothermic sections is represented by $T_2$, the casting temperature T for the semi-molten Al-Si based alloy material is set in a range of $T_1 \leqq T \leqq T_2$. Thus, the fine precipitation of a primary crystal Si phase can be realized to provide an increase in strength of an aluminum alloy cast product.

7 Claims, 31 Drawing Sheets

Example $A_2$

25μm

Example $A_1$

100μm

Example $A_1$

Example $A_2$

Example $A_1$ (S = 40 %)

100μm

Example $C_1$ (S = 40 %)

100μm

Example $F_1$ (S = 40 %)

Example $F_4$ (S = 0 %)

Example $C_4$ (S = 0 %)

Example $B_1$

THIXOCASTING PROCESS, AND THIXOCASTING ALUMINUM ALLOY MATERIAL

BACKGROUND OF THE INVENTION

1. Field of the Invention

The present invention relates to a thixocasting process, and particularly, to an improvement in a thixocasting process which involves subjecting an aluminum alloy material to a heating treatment to prepare a semi-molten aluminum alloy material having a solid phase (which is a substantially solid phase and this term will also be applied hereinafter) and a liquid phase coexisting therein, pouring the semi-molten aluminum alloy material into a cavity in a casting mold under pressure, and then solidifying the semi-molten aluminum alloy material under pressure.

2. Description of the Related Art

There is a conventionally known thixocasting aluminum alloy material which has a hypo eutectic crystal composition and a characteristic that a first angled endothermic section appearing due to the melting of a eutectic crystal and a second angled endothermic section appearing due to the melting of a component having a melting point higher than a eutectic point in a differential calorimetric curve. In a thixocasting process using such material, if the temperature of a drop-end point in the first angled endothermic section is represented by $T_2$, and the temperature of a peak in the second angled endothermic section is represented by $T_3$, the casting temperature of the semi-molten aluminum alloy material is set in a range of $T_2 \leqq T \leqq T_3$.

The reason why the casting temperature T is set at a relative high level in this manner is for the purpose of decreasing the solid phase proportion in the semi-molten aluminum alloy material to improve the castability of the latter.

In this case, the metallographic structure of the resulting aluminum alloy cast product comprises an $\alpha$ phase formed by the solidification of the solid phase, and a matrix, i.e., a $\alpha$-$\beta$ eutectic crystal phase formed by the solidification of the liquid phase. The aluminum alloy cast product has a mechanical characteristic depending upon the metallographic structure thereof.

To further enhance the mechanical characteristic of the aluminum alloy cast product, it is contemplated to cause a $\beta$ phase to be finely precipitated in the matrix. However, it is impossible to realize the fine precipitation of the $\beta$ phase by the conventional process.

To achieve a further increase in strength and a reduction in weight of the aluminum alloy cast product, an Al-$Mg_2Si$ based alloy material as an aluminum alloy malleable material may be used as a thixocasting aluminum alloy material. In this case, if the content of Mg in the Al-$Mg_2Si$ based alloy material, i.e., the $Mg_2Si$ content is too small, the liquid phase amount is insufficient due to the appearing of only a single angled endothermic section in the differential calorimetric curve. For this reason, a shrink cavity is liable to be produced around a spherical $\alpha$-Al portion of the aluminum alloy cast product. On the other hand, if the $Mg_2Si$ content is too large, the following problem is encountered: a large amount of bulky brittle $Mg_2Si$ crystals exist in the aluminum alloy cast product, and the liquid phase content is increased, so that the amount of hydrogen dissolved in the liquid phase is increased. For this reason, blow holes are liable to be produced in the aluminum alloy cast product, thereby causing a reduction in strength of the aluminum alloy cast product.

Further, a thixocasting aluminum alloy material is also used which contains a relatively large amount of Sr added thereto. The reason why the Sr content is defined is to reliably finely divide the metallographic structure of the matrix produced by the solidification of the liquid phase and to increase the electric resistance value of the aluminum alloy material to enhance the red-heated degree of the semi-molten aluminum alloy material by an induction heating. However, there is a problem that if the amount of Sr added and the shear rate of the semi-molten aluminum alloy material in the cavity are unsuitable, the toughness of the aluminum alloy cast product is largely lost.

Yet further, there is a conventionally known thixocasting aluminum alloy material having a characteristic that a first endothermic section appearing due to the melting of a eutectic component and a second endothermic section appearing due to the melting of a component having a melting point higher than a eutectic point exist in a differential calorimetric curve. If the maximum value of the distance between a straight line interconnecting a melt-start point of the eutectic component and a melt-end point of the high-melting component and the first endothermic section is represented by t, and the maximum value of the distance between such straight line and the second endothermic section is represented by u, the ratio u/t of the maximum value u to the maximum value t is in a range of $u/t>0.1$.

However, the known semi-molten aluminum alloy material suffers from the following problem: The high-melting component is colloidal and is in a softened state. In addition, since the ratio u/t is in the range of $u/t>0.1$, the amount of heat of the solidification of the high-melting component is large and hence, the time until the solidification of such component is relatively long. Due to these facts, the high-melting component is agglomerated to cause a deterioration in the fluidity of the semi-molten aluminum alloy material and hence, casting defects such as a cold shut are liable to be produced in an aluminum alloy product.

SUMMARY OF THE INVENTION

Accordingly, it is an object of the present invention to provide a thixocasting process of the above-described type, by which a fine precipitation of a $\beta$ phase can be realized using an aluminum alloy material having a hypo eutectic crystal composition.

To achieve the above object, according to the present invention, there is provided a thixocasting process comprising the steps of: subjecting, to a heating treatment, an aluminum alloy material having a hypo eutectic crystal composition and a characteristic that a first angled endothermic section appearing due to the melting of a eutectic crystal and a second angled endothermic section appearing due to the melting of a component having a melting point higher than a eutectic point coexist in a differential calorimetric curve, thereby preparing a semi-molten aluminum alloy material having solid and liquid phases coexisting therein; pouring the semi-molten aluminum alloy material into a cavity in a casting mold under pressure; and solidifying the semi-molten aluminum alloy material under pressure, wherein when the temperature of a rise-start point in the first angled endothermic section is represented by $T_1$, and the temperature of a drop-end point of the first section is represented by $T_2$, the casting temperature of the semi-molten aluminum alloy material is set in a range of $T_1 \leqq T \leqq T_2$.

If the casting temperature is set in such range, the liquid phase has a eutectic composition in such range of the temperature T, i.e., in the range of $T_1 \leqq T \leqq T_2$. In the solidifying step, the composition of the liquid phase is varied so as to waver toward an over-eutectic crystal side and a hypo eutectic crystal side across the eutectic point serving as a boundary. Therefore, a β phase is precipitated on the over-eutectic side and an α-β eutectic crystal is precipitated on the hypo eutectic side. In this case, the growth of the β phase is hindered by the α phase which is a solid phase and hence, the fine division of the β phase is achieved.

If the casting temperature T is set as described above, the proportion of the solid phase in the semi-molten aluminum alloy material is increased, but the β phase exhibits an effect of inhibiting the mutual agglomeration of the solid phases and hence, the semi-molten aluminum alloy material has a good fluidity.

Thus, it is possible to produce an aluminum alloy cast product which is free from casting detects and has a hypo eutectic crystal composition and a mechanical characteristic enhanced more than that of the conventional aluminum alloy cast product.

However, if the casting temperature T is lower than $T_1$ ($T<T_1$), the liquid phase cannot exist in an aluminum alloy material. On the other hand, if $T>T_2$, the precipitation of the β phase cannot be realized.

It is another object of the present invention to provide the thixocasting process of the above-described type capable of producing an aluminum alloy cast product having a high strength and a light weight by using an aluminum alloy material having a specified content of $Mg_2Si$.

To achieve the above object, according to the present invention, there is provided a thixocasting process comprising the steps of: subjecting an aluminum alloy material to a heating treatment to prepare a semi-molten aluminum alloy material having solid and liquid phases coexisting therein; and pouring the semi-molten aluminum alloy material into a cavity in a casting mold under pressure, wherein the aluminum alloy material used is a material having a $Mg_2Si$ content in a range of 2% by weight $\leqq Mg_2Si \leqq 11\%$ by weight.

In the above aluminum alloy, if the $Mg_2Si$ content is set as described above, the liquid phase amount is suitable in the semi-molten aluminum alloy material. Therefore, during pouring of the semi-molten aluminum alloy material, the liquid phase is supplied sufficiently to portions around the solid phase, and a $Mg_2Si$ portion of an aluminum alloy cast product is finely divided and is of a suitable presence amount. Further, the aluminum alloy material is used in a semi-molten state and moreover, the content of $Mg_2Si$ which will be the liquid phase is set as described above, and hence, the liquid phase amount is small, whereby the amount of hydrogen into the liquid phase is largely decreased.

In this manner, it is possible to produce an aluminum alloy cast product which is free from casting defects such as a shrinkage cavity, blow holes and the like, and has a high strength and a light weight.

However, if the $Mg_2Si$ content in the aluminum alloy material is in a range of $Mg_2Si<2\%$ by weight, a shrinkage cavity is liable to be produced in an aluminum alloy cast product as a result of a decrease in liquid phase amount. On the other hand, if $Mg_2Si>11\%$ by weight, a brittle $Mg_2Si$ crystal exists in a large amount in an aluminum alloy cast product and moreover, blow holes are liable to be produced in the aluminum alloy cast product as a result of an increase in liquid phase amount.

It is a further object of the present invention to provide an aluminum alloy material of the above-described type from which an aluminum alloy cast product having a high strength and a light weight can be produced utilizing a thixocasting process.

To achieve the above object, according to the present invention, there is provided a thixocasting aluminum alloy material which is to be poured into a cavity in a casting mold in a semi-molten state having solid and liquid phase coexisting therein and which has a $Mg_2Si$ content set in a range of 2% by weight $\leqq Mg_2Si \leqq 11\%$ by weight.

By carrying out a thixocasting process using the above aluminum alloy material, an aluminum alloy cast product free from casting defects such as a shrinkage cavity, blow holes and the like and having a high strength and a light weight can be produced. In this case, the reason why the $Mg_2Si$ content is limited is as described above.

Further, it is another object of the present invention to provide a thixocasting process of the above-described type, which is capable of producing an aluminum alloy cast product having a high toughness by specifying the amount Sr added and the shear rate Rs.

To achieve the above object, according to the present invention, there is provided a thixocasting process comprising the steps of subjecting an aluminum alloy material, to a heating treatment to prepare a semi-molten aluminum alloy material having solid and liquid phases coexisting therein, pouring the semi-molten aluminum alloy material into a cavity in a casting mold under pressure, and solidifying the semi-molten aluminum alloy material under pressure, wherein the amount of Sr added in the aluminum alloy material is set in a range of 0 ppm$<Sr \leqq 100$ ppm, and the shear rate Rs of the semi-molten aluminum alloy material in the cavity is set in a range of $Rs \geqq 50\ S^{-1}$.

If the amount of Sr added and the shear rate Rs are set as described above, notwithstanding that the amount of Sr added is very small, the metallographic structure of a matrix produced by the solidification of the liquid phase can be reliably finely divided, and the wettability of the matrix and a dispersion phase produced by the solidification of the solid phase can be improved, thereby enhancing the toughness of the aluminum alloy cast product. In addition, a red-heated degree of the semi-molten aluminum alloy material by a high-frequency heating is sufficiently enhanced by the amount of Sr added.

However, if the amount of Sr added is equal to 0 ppm, even if the shear rate Rs is set in the range of $Rs \geqq 50\ S^{-1}$, the matrix cannot be finely divided, and the red-heated degree is decreased. On the other hand, if the amount of Sr added is larger than 100 ppm, even if the shear rate Rs is set in the range of $Rs \geqq 50\ S^{-1}$, the wettability of the matrix and the dispersion phase is not improved and hence, an aluminum alloy cast product has substantially the same toughness as that obtain when $Rs<50\ S^{-1}$. Further, even if the amount of Sr added is in the range of 0 ppm$<Sr \leqq 100$ ppm, if the shear rate Rs is smaller than $50\ S^{-1}$, an aluminum alloy cast product has substantially the same toughness as that obtained when $Sr>100$ ppm.

It is a yet further object of the present invention to provide a thixocasting process of the above-described type which is capable of producing an aluminum alloy cast product having a high toughness.

To achieve the above object, according to the present invention, a thixocasting aluminum alloy material which contains Sr added thereto as a modifying agent, the amount of Sr added being set in a range of 0 ppm$<Sr \leqq 100$ ppm.

The use of this aluminum alloy material makes it possible to produce an aluminum alloy cast product having a high toughness by utilizing a thixocasting process.

Yet further, it is an object of the present invention to provide a thixocasting aluminum alloy material of the above-described type wherein the agglomeration of a high-melting component in a semi-molten state is avoided, so that the material has a good fluidity.

To achieve the above object, according to the present invention, there is provided a thixocasting aluminum alloy material which has a characteristic that a first angled endothermic section appearing due to the melting of a eutectic component and a second angled endothermic section appearing due to the melting of a component having a melting point higher than a eutectic point in a differential calorimetric curve, and in which when the maximum value of the distance between the first endothermic section and a straight line interconnecting a melt-start point of the eutectic component and a melt-end point of the high-melting component is represented by t, and the maximum value of the distance between the straight line and the second endothermic section is represented by u, the ratio u/t of the maximum value u to the maximum value t is in a range of $u/t \leqq 0.1$.

If the ratio u/t is in the range of $u/t \leqq 0.1$ as described above, the heat amount of solidification of the high-melting component is small and hence, the time taken for such component to be solidified is shortened. Thus, the agglomeration of the high-melting component in the semi-molten aluminum alloy material is avoided and hence, such aluminum alloy material has a good fluidity.

However, for maintaining the shape of the semi-molten aluminum alloy material, it is desirable that the lower limit of the ratio u/t is equal to 0.005.

The above and other objects, features and advantages of the invention will become apparent from the following description of the preferred embodiments taken in conjunction with the accompanying drawings.

DETAILED DESCRIPTION OF THE PREFERRED EMBODIMENTS

[Embodiment I]

Figure 1:
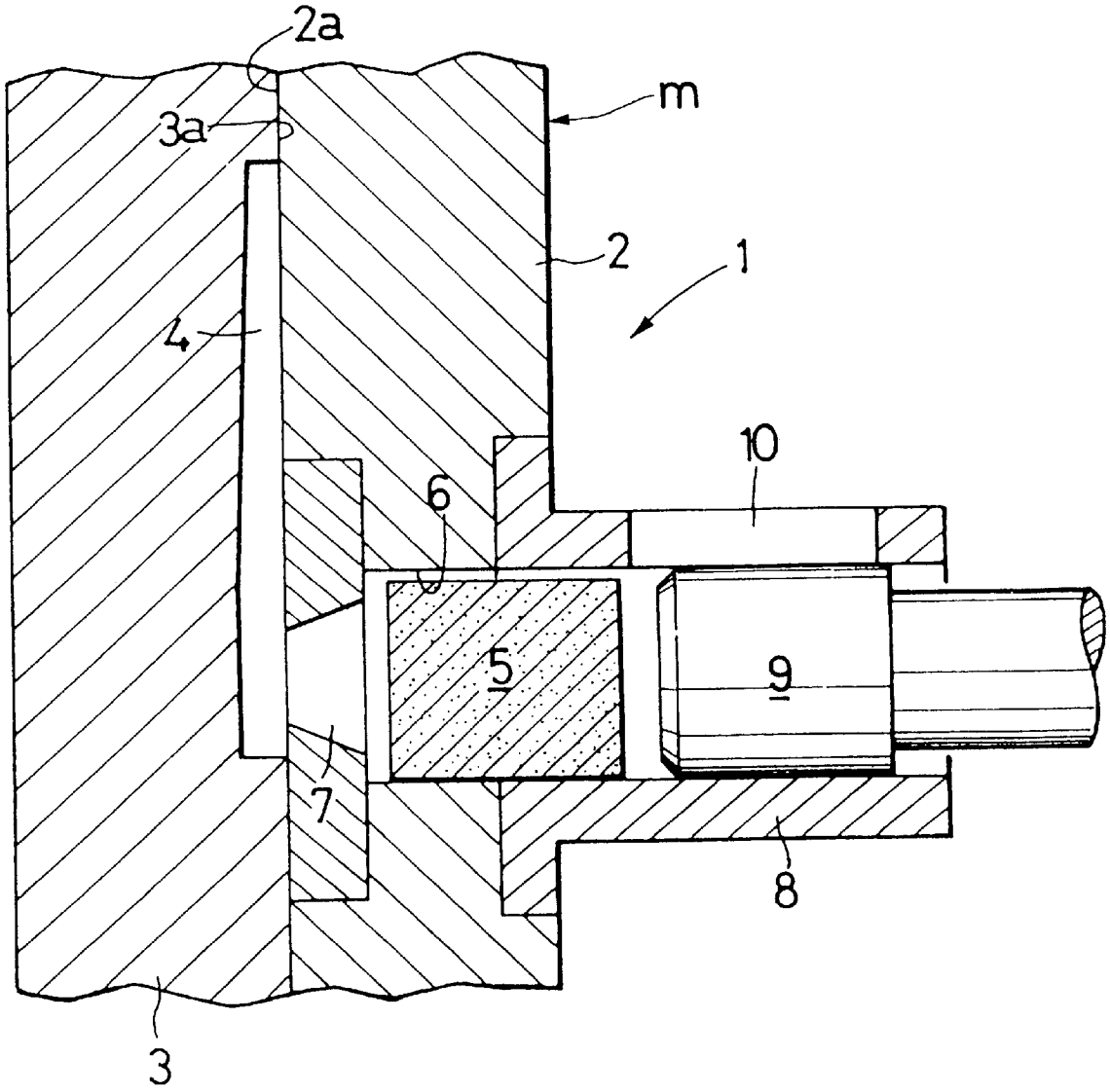
FIG. 1 is a longitudinal sectional front view of one example of a pressure casting machine.

A pressure casting machine 1 shown in FIG. 1 is used to cast an aluminum alloy cast product in a thixocasting process using an aluminum alloy material. The pressure casting machine 1 includes a casting mold m which is comprised of a stationary die 2 and a movable die 3 having vertical mating faces 2*a* and 3*a*. A cast product forming cavity 4 is defined between the mating faces 2*a* and 3*a*. A chamber 6 for placement of a semi-molten aluminum alloy material 5 is defined in the stationary die 2 and communicates with the cavity 4 through a gate 7. A sleeve 8 is horizontally mounted to the stationary die 2 to communicate with the chamber 6, and a pressing plunger 9 is slidably received in the sleeve 8 and inserted into and withdrawn from the chamber 6. The sleeve 8 has a material insertion inlet 10 in an upper portion of a peripheral wall thereof. In this case, the clamping force is set, for example, at 200 tons, and the input pressure is set, for example, at 20 tons.

EXAMPLE 1

Table 1 shows the composition of an example A of an Al-Si based alloy material having a hypo eutectic crystal composition. The example A is made by cutting from a long continuous cast material having a high quality and produced utilizing a continuous casting process. In producing the long continuous cast material in the casting process, a spheroidization of α-aluminum is performed. The example A has a diameter of 50 mm and a length of 65 mm.

TABLE 1

| Example A of Al-Si based | Chemical constituent (% by weight) | | | | |
|---|---|---|---|---|---|
| alloy material | Si | Mg | Fe | Sr | Balance |
| | 6.9 | 0.57 | 0.10 | 0.034 | Al |

Figure 2:
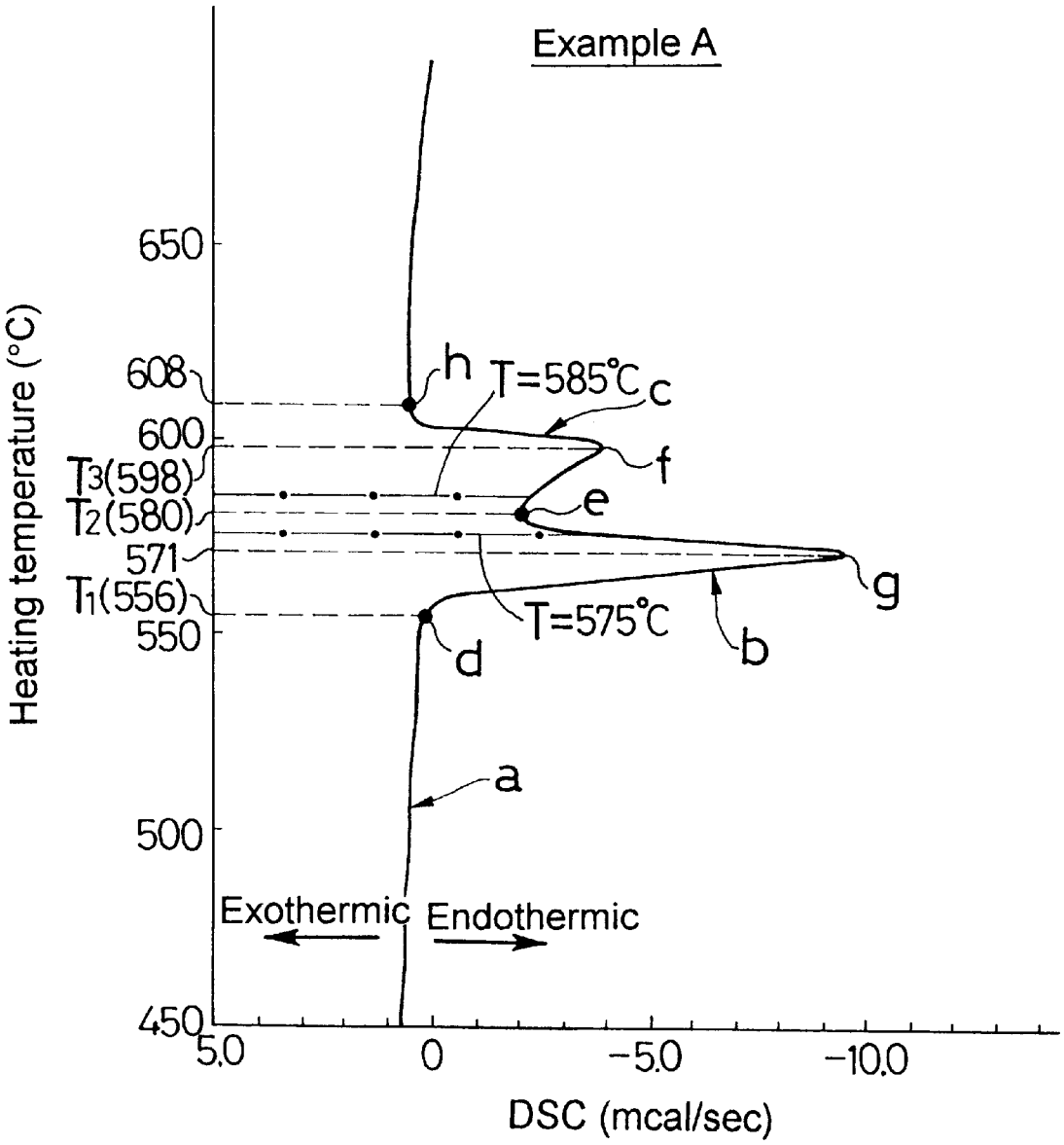
FIG. 2 is a differential calorimetric curve for an example A of an Al-Si based alloy material.

The example A was subjected to a differential scanning calorimetry (DSC) to provide the results shown in FIG. 2. In a differential calorimetric curve a in FIG. 2, a first angled endothermic section b appearing due to the melting of a eutectic crystal and a second angled endothermic section c appearing due to the melting of a component having a melting point higher than a eutectic point exist. The temperature $T_1$ of a rise-start point d in the first angled endothermic section b is equal to 556° C., and the temperature $T_2$ of a drop-end point also (corresponding to a rise-start point in the second angled endothermic section c is equal to 580° C. The temperature $T_3$ of a peak f in the second angled endothermic section c is equal to 598° C. The temperature of a peak g in the first angled endothermic section b is 571° C., and the temperature of a drop-end point h of the second angled endothermic section c is 608° C.

The example A was placed into a heating coil of an induction heating device and then heated under conditions of a frequency of 1 kHz and a maximum output power of 37 kW to prepare a semi-molten Al-Si based alloy material having solid and liquid phases coexisting therein. In this case, the heating temperature for the example A was set at 575° C., and the solid phase rate was set at 70%.

Thereafter, the example A of the semi-molten Al-Si based alloy material 5 was placed into the chamber 6 and forced into the cavity 4 through the gate 7 while being pressurized under conditions of a casting temperature T=575° C. ($T_1 \leqq T \leqq T_2$), a moving speed of the pressing plunger 9 of 0.2 m/sec and a mold temperature of 250° C. A pressing force was applied to the example A filled in the cavity 4 by retaining the pressing plunger 9 at a stroke terminal end, thereby solidifying the example A under such a pressure to provide an aluminum alloy cast product $A_1$.

For the comparison, the casting operation was carried out under the same conditions, except that the casting temperature T of the example A was set at 585° C. ($T_2 \leqq T \leqq T_3$), and the solid phase rate was set at 45%, thereby producing an aluminum alloy cast product $A_2$.

Figure 3:
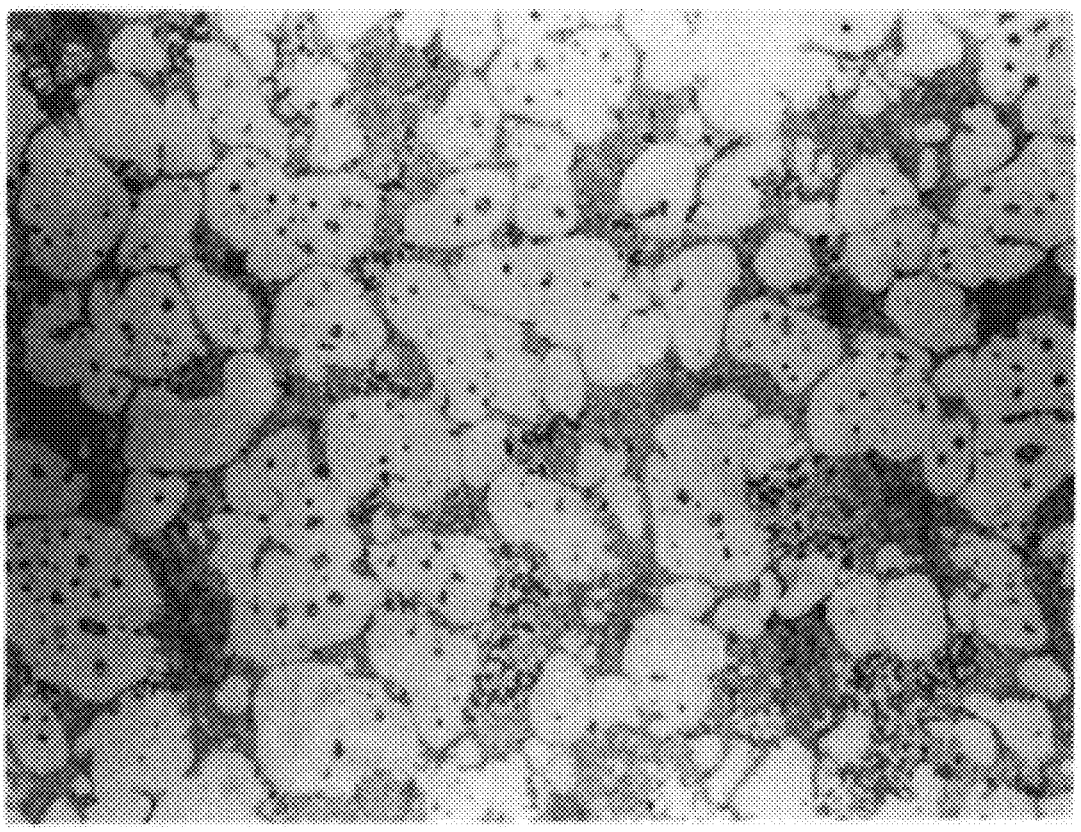
FIG. 3 is photomicrograph showing the metallographic structure of an example $A_1$ of an aluminum alloy cast product.
Figure 4A:
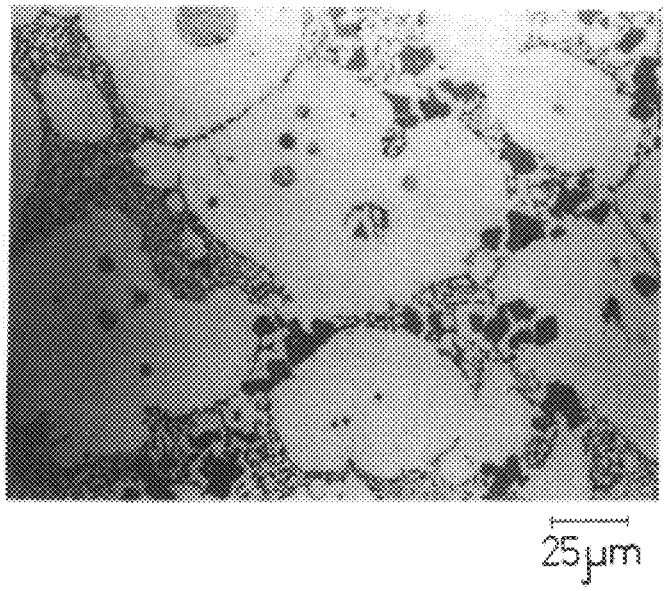
FIG. 4A corresponds to a partially enlarged photograph of FIG. 3.
Figure 4B:
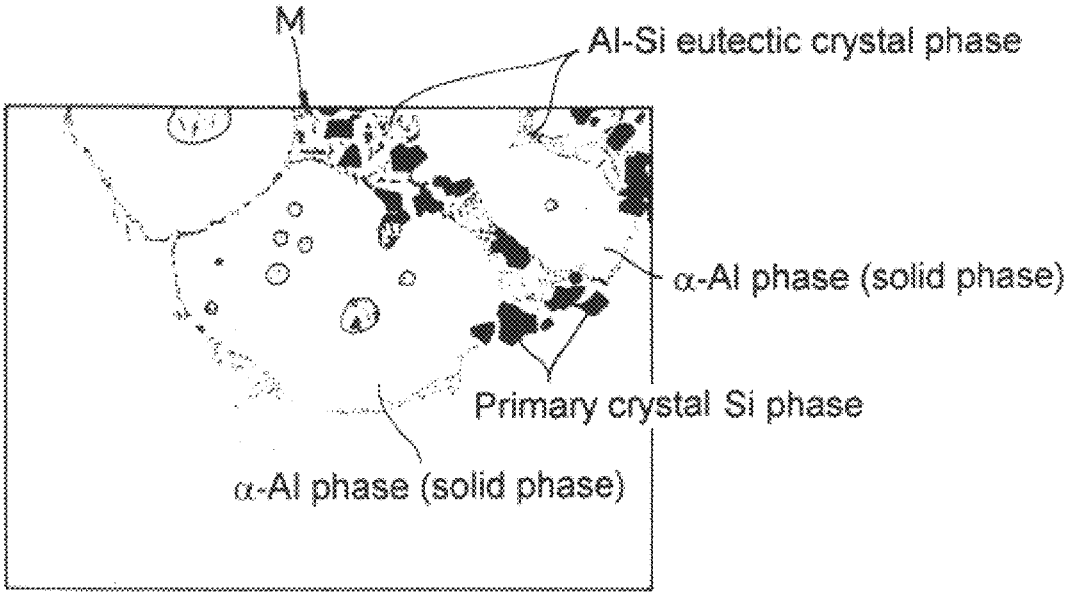
FIG. 4B is a tracing of an essential portion of FIG. 4A.

FIGS. 3 and 4A are photomicrographs showing the metallographic structure of the aluminum alloy cast product $A_1$, and FIG. 4B is a tracing of an essential portion of FIG. 4A. The metallographic structure is comprised of an α-Al phase formed by the solidification of a solid phase, and a matrix M and thus a primary crystal Si phase and an Al-Si eutectic crystal phase formed by the solidification of a liquid phase. In this case, the primary crystal Si phase was dispersed around the solid-phase and has a volume fraction rate Vf of 2.8%.

Figure 5:
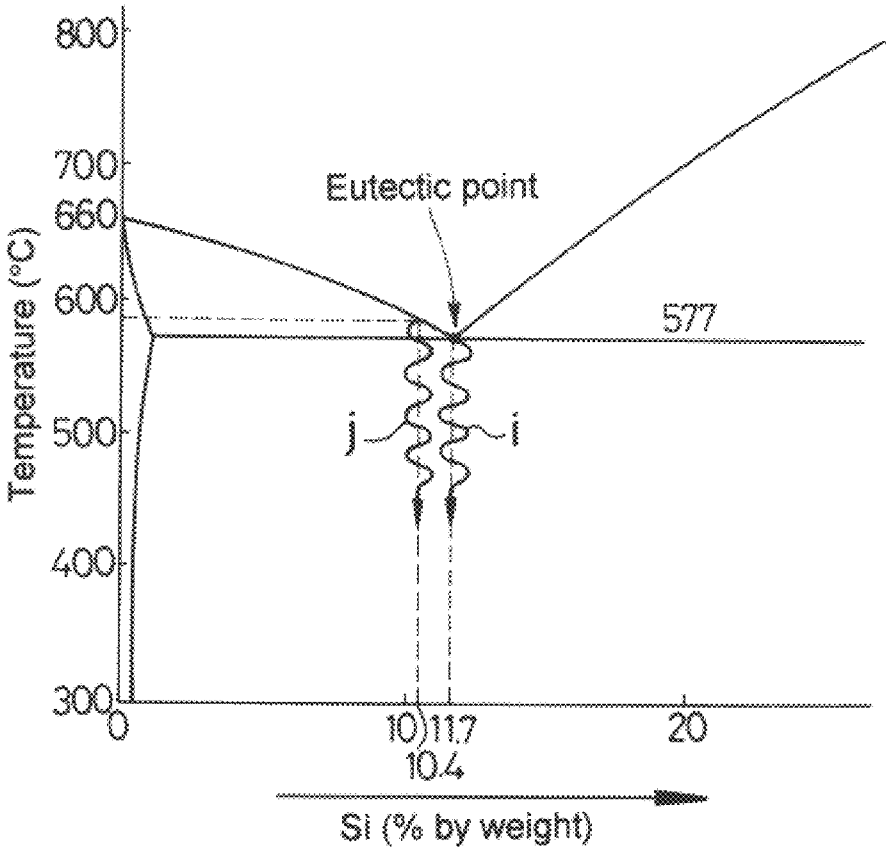
FIG. 5 shows an essential portion of a state graph of an Al-Si based alloy.

The reason why the metallographic structure having the primary crystal Si phase existing therein was produced in spite of the use of the Al-Si based alloy material having the hypo eutectic crystal composition as described above is as follows: if the casting temperature T is set at 575° C., the liquid phase has a eutectic composition containing 11.7% by weight of Si, as shown in FIG. 5, because the temperature T is in a range of $T_1$ (556° C.)$\leqq$T (575° C.)$\leqq T_2$ (580° C.) in FIG. 2. In the solidifying step, the composition of the liquid phase is varied so as to waver toward an over-eutectic crystal side and a hypo eutectic crystal side across the eutectic point serving as a boundary, as shown by a curve i in FIG. 5 and hence, a primary crystal Si phase is precipitated on the over-eutectic side and an Al-Si eutectic crystal is precipitated on the hypo eutectic side.

In this case, the growth of the primary crystal Si phase is hindered by the α-Al phase which is a solid phase and hence, the grain size D of the primary crystal Si phase is in a range of 5 $\mu$m$\leqq$D$\leqq$20 $\mu$m. In carrying out a gravity casting using an Al-Si based alloy material having an over-eutectic composition, the fine division of the primary crystal Si phase is performed using P or the like. In this case, the grain size D of the primary crystal Si phase is in a range of 20 $\mu$m$\leqq$D$\leqq$50 $\mu$m. If the case of the grain size D in the range of 5 $\mu$m$\leqq$D$\leqq$20 $\mu$m is compared with the case of the grain size D in the range of 20 $\mu$m$\leqq$D$\leqq$50 $\mu$m, it can be seen that the further fine division of the primary crystal Si phase is achieved according to the above-described process.

If the casting temperature T is set as described above, the solid phase rate in the semi-molten Al-Si based alloy material is increased to 70%. However, the primary crystal Si phase exhibited an effect of inhibiting the mutual agglomeration of the solid phases and hence, the semi-molten Al-Si based alloy material had a good fluidity, and the generation of casting defects was not observed in the aluminum alloy cast product.

Figure 6:
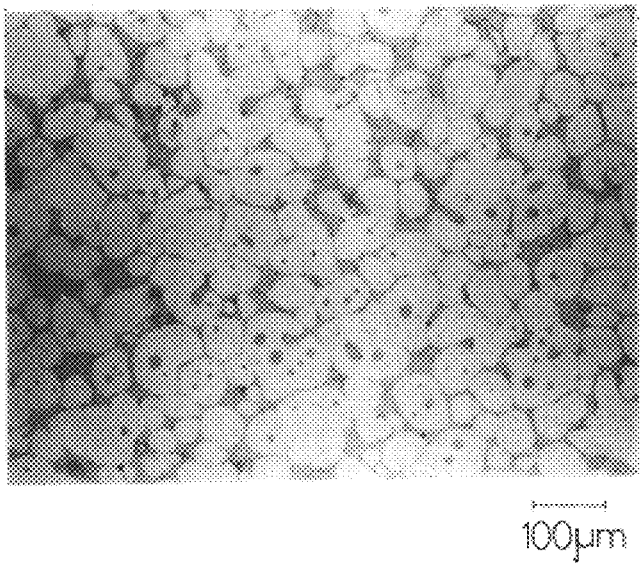
FIG. 6 is a photomicrograph showing the metallographic structure of an example $A_2$ of an aluminum alloy cast product.
Figure 7A:
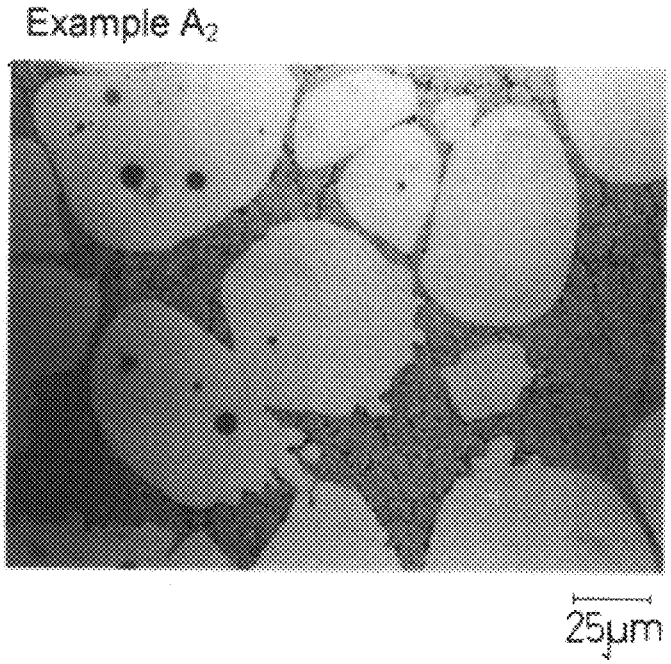
FIG. 7A corresponds to a partially enlarged photograph of FIG. 6.
Figure 7B:
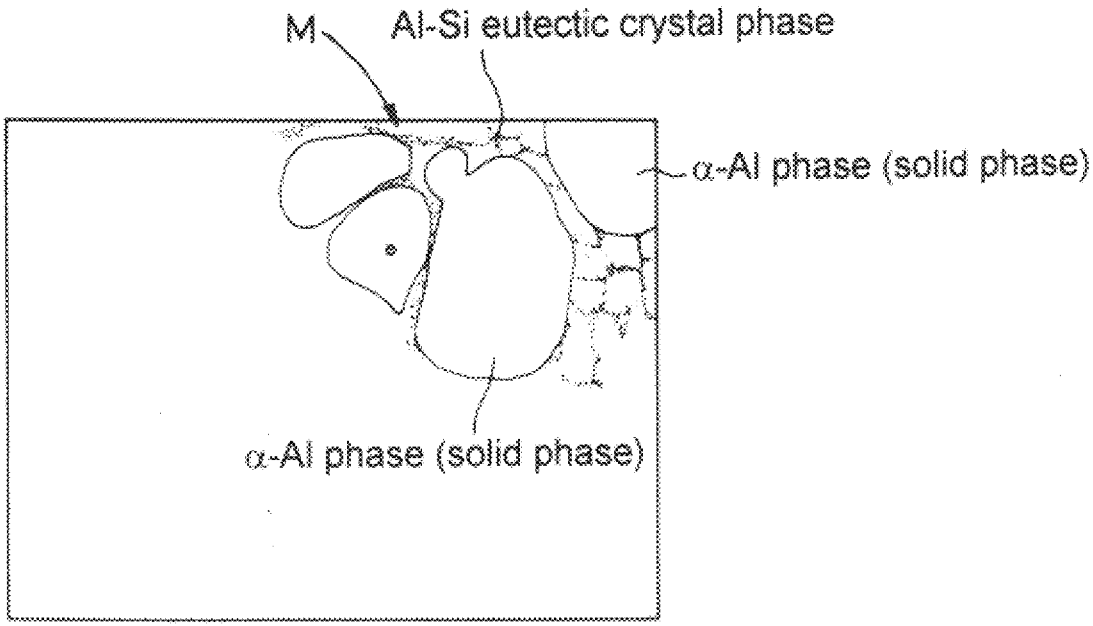
FIG. 7B is a tracing of an essential portion of FIG. 7A.

FIGS. 6 and 7A are photomicrographs showing the metallographic structure of an example $A_2$ of an aluminum alloy cast product, and FIG. 7B is a tracing of an essential portion of FIG. 7A. This metallographic structure is comprised of an α-Al phase and a matrix and thus an Al-Si eutectic crystal formed by the solidification of a liquid phase. No primary crystal Si phase exists in this metallographic structure.

The reason why no primary crystal Si phase exists is as follows: if the casting temperature T is set at 585° C., the liquid phase has a hypo eutectic crystal composition containing about 10.4% by weight of Si, as shown in FIG. 5, because the temperature T is in a range of $T_2$ (580° C.)≦T (585° C.)≦$T_3$ (598° C.) in FIG. 2. In the solidifying step, the composition is varied so as to waver toward a higher-Si side and a lower-Si side across about 10.4% by weight of Si, as shown by a curve j in FIG. 5, but cannot exceed a eutectic point. Therefore, no primary crystal Si phase is precipitated.

Test pieces $A_1$ and $A_2$ were made from the aluminum alloy cast product examples $A_1$ and $A_2$ and subjected to a T6 treatment and then to a tensile test and a Charpy impact test to provide results given in Table 2.

TABLE 2

| Test piece | 0.2% proof strength (MPa) | Tensile strength (MPa) | Elongation (%) | Charpy impact value (J/cm$^2$) |
|---|---|---|---|---|
| $A_1$ | 311 | 342 | 7.5 | 3.9 |
| $A_2$ | 254 | 319 | 10.9 | 5.8 |

As is apparent from Table 2, the test piece $A_1$ having the primary crystal Si phase existing therein has an enhanced strength, as compared with the test piece $A_2$ having no primary crystal Si phase. In the test piece $A_1$, reductions in ductility and toughness were inhibited, because the primary crystal Si phase was finely divided and had a suitable volume fraction rate Vf.

EXAMPLE 2

Table 3 shows chemical constituents of examples $B_1$, $B_2$ and $B_3$ of Al-Si based alloy materials having a hypo eutectic crystal composition and an example $B_4$ of an Al-Si based alloy material having an over-eutectic composition. These examples $B_1$ to $B_4$ are materials cut away from a long continuous cast product made in a continuous casting process, and in this casting thereof, the spheroidization of α-Al was performed. Each of the examples $B_1$ to $B_4$ had a diameter of 50 mm and a length of 65 mm.

TABLE 3

| Example of Al-Si based alloy material | Chemical constituent (% by weight) | | | |
|---|---|---|---|---|
| | Si | Mg | Cu | Balance |
| $B_1$ | 3.2 | 0.5 | — | Al |
| $B_2$ | 5.7 | 0.5 | — | Al |
| $B_3$ | 9.1 | 0.8 | 2.8 | Al |
| $B_4$ | 12.9 | 0.2 | 3.8 | Al |

Each of the examples $B_1$ to $B_4$ was subjected to a differential scanning calorimetry (DSC) and as a result, it was made clear that a first angled endothermic section appearing due to the melting of a eutectic crystal and a second angled endothermic section appearing due to the melting of a component having a melting point higher than a eutectic point exist in a differential calorimetric curve.

Table 4 shows temperatures of various points in the differential calorimetric curve.

TABLE 4

| Example of Al-Si based alloy material | Temperatures (°C.) of points in first angled endothermic section b | | | Temperature (°C.) of points in second angled endothermic section c | |
|---|---|---|---|---|---|
| | Rise-start point d ($T_1$) | Peak g | Drop-end point e ($T_2$) | Peak + ($T_3$) | Drop-end point h |
| $B_1$ | 575 | 582 | 590 | 640 | 645 |
| $B_2$ | 558 | 571 | 580 | 610 | 620 |
| $B_3$ | 504 | 565 | 577 | 595 | 603 |
| $B_4$ | 505 | 510 | 514 | 570 | 580 |

Then, the example $B_1$ was placed into the heating coil in the induction heating device and then heated under conditions of a frequency of 1 kHz and a maximum output power of 37 kW to prepare an example $B_1$ of a semi-molten Al-Si based alloy material having solid and liquid phases coexisting therein.

Thereafter, as shown in FIG. 1, the example $B_1$ of the semi-molten Al-Si based alloy material was placed into the chamber 6 and forced into the cavity 4 through the gate 7 while being pressurized under conditions of a moving speed of the pressing plunger 9 of 0.2 m/sec and a mold temperature of 250° C. A pressing force was applied to the example $B_1$ filled in the cavity 4 by retaining the pressing plunger 9 at a stroke terminal end, thereby solidifying the example $B_1$ under pressure to produce an example $B_1$ of an aluminum alloy cast product. Using examples $B_2$, $B_3$ and $B_4$ of other Al-Si based alloy materials, the same casting operation was carried out to produce examples $B_2$, $B_3$ and $B_4$ of aluminum alloy cast products.

The metallographic structure of each of the examples $B_2$, $B_3$ and $B_4$ of the aluminum alloy cast products was examined. It was made clear from the result that the metallographic structure was comprised of an α-Al phase formed by the solidification of a solid phase and a matrix M and thus a primary crystal Si phase and an Al-Si eutectic crystal phase formed by the solidification of a liquid phase. In addition, no casting defect was observed in each of the examples $B_2$, $B_3$ and $B_4$ of the aluminum alloy cast products.

Figure 8:
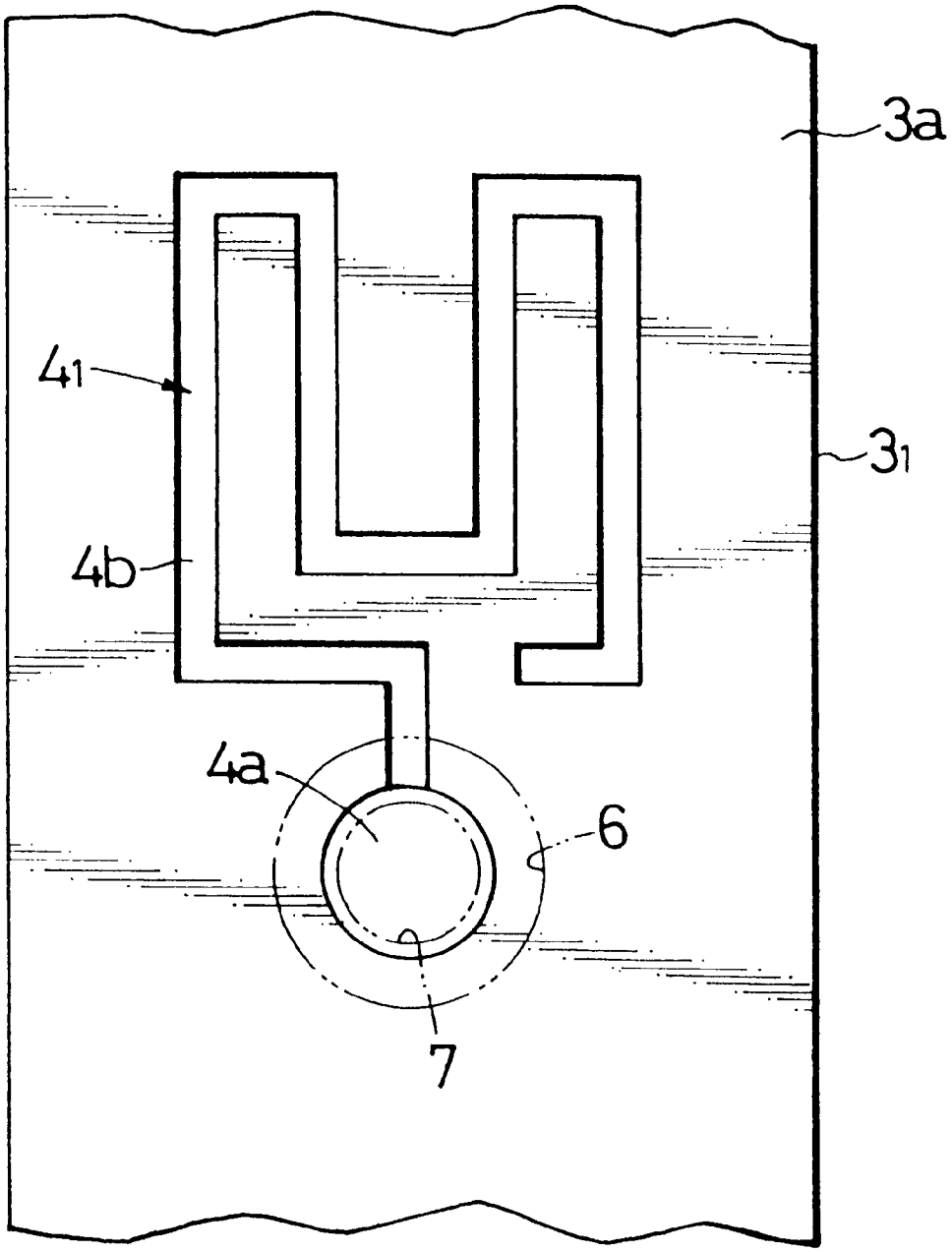
FIG. 8 is a side view of an essential portion of a movable die.

Then, the examples $B_1$, $B_2$, $B_3$ and $B_4$ of the Al-Si based alloy materials were subjected to a fluidity test. A movable die $\mathbf{3}_1$ used for this test includes a cavity $\mathbf{4}_1$ which is comprised of a circular portion 4*a* communicating with the gate 7, and a substantially U-shaped bent portion 4*b* extending from the circular portion 4*a*, as shown in FIG. 8.

In the fluidity test, first, an example $B_1$ of a semi-molten Al-Si based alloy material was prepared under the same conditions as in the casting operation. Then, the example $B_1$ was forced into the cavity $\mathbf{4}_1$ under the same conditions and solidified therein.

After opening of the mold, the weight of a solidified material $B_1$ existing in the bent portion 4*b* of the cavity $\mathbf{4}_1$ was measured. Such weight was defined as a flow length.

The other examples $B_2$, $B_3$ and $B_4$ of the Al-Si based alloy materials were subjected to the same fluidity test as that described above to measure their flow lengths.

The flow length of the example $B_1$ was defined as "1.0", and the flow length ratio of the other examples $B_2$, $B_3$ and $B_4$ was determined.

Further, test pieces were fabricated from the four examples $B_1$, $B_2$, $B_3$ and $B_4$ of aluminum alloy cast products and subjected to a T6 treatment and then to a Charpy impact test.

Table 5 shows the casting temperature T, the solid phase rate and various measurements for the examples $B_1$, $B_2$, $B_3$ and $B_4$ of aluminum alloy cast products.

TABLE 5

| Example of Al alloy cast product | Casting temperature T (°C.) | Solid phase rate (%) | Flow length ratio | Primary Si phase Grain diameter (μm) | Primary Si phase Vf (%) | Charpy impact value (J/cm²) |
|---|---|---|---|---|---|---|
| $B_1$ | 585 | 70 | 1.0 | 5≦ ≦20 | 1.5 | 14.1 |
| $B_2$ | 575 | 70 | 1.12 | 5≦ ≦20 | 3.0 | 11.3 |
| $B_3$ | 568 | 70 | 1.18 | 5≦ ≦20 | 4.7 | 3.1 |
| $B_4$ | 565 | 70 | 1.19 | 10≦ ≦50 | 6.7 | 1.2 |

It can be seen from Table 5 that the casting temperature T for the examples $B_1$, $B_2$, $B_3$ and $B_4$ of the aluminum alloy cast products was set in a range of $T_1 \leqq T \leqq T_2$. It can be also seen that if the volume fraction rate Vf of the primary crystal Si phase is increased, the fluidity of the semi-molten Al-Si based alloy material is enhanced.

Figure 9:
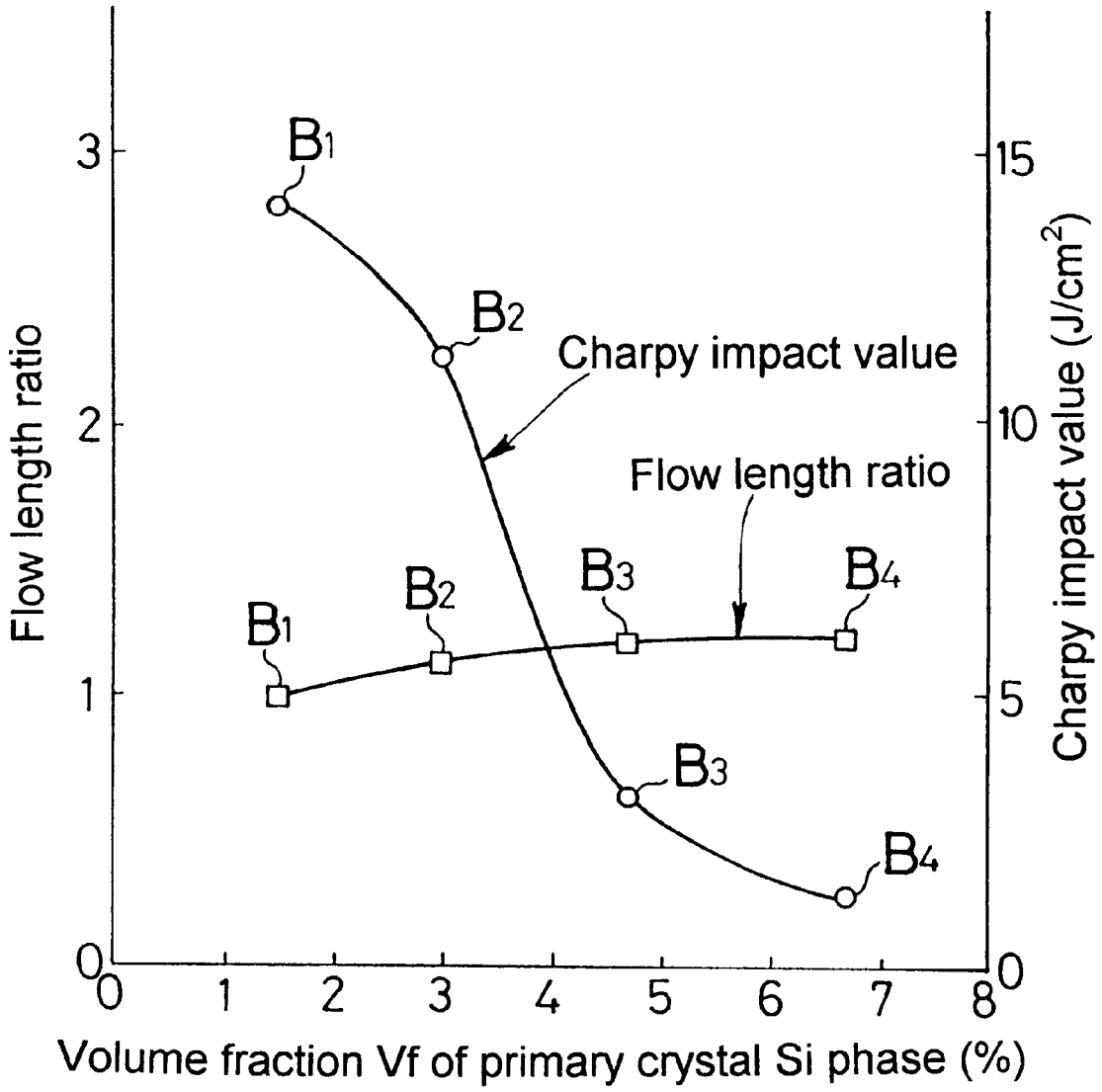
FIG. 9 is a graph illustrating the relationship between the volume fraction rate Vf of a primary crystal Si phase and the flow length ratio as well as the Charpy impact value.

FIG. 9 is a graph taken from Table 5 and showing the relationship between the volume fraction Vf of the primary crystal Si phase and the flow length ratio as well as the Charpy impact value for the aluminum alloy cast product examples $B_1$, $B_2$, $B_3$ and $B_4$. In FIG. 9, points $B_1$, $B_2$, $B_3$ and $B_4$ correspond to the aluminum alloy cast product examples $B_1$, $B_2$, $B_3$ and $B_4$. The relationship between the point and the example applies to Figures which will be described hereinafter.

As is apparent from Table 5 and FIG. 9, if the grain size D of the primary crystal Si phase is in the range of 5 $\mu m \leqq D \leqq 20\ \mu m$ and the volume fraction Vf thereof is in the range of $1.5\% \leqq Vf \leqq 4.7\%$ as in the aluminum alloy cast product examples $B_1$, $B_2$ and $B_3$, the fluidity of the semi-molten Al-Si based alloy material can be improved; the generation of casting defects can be prevented, and the strength and toughness of the aluminum alloy cast product can be insured.

The flow length ratio for the aluminum alloy cast product example $A_1$ in Example 1 was 1.1.

The aluminum alloy materials include not only the Al-Si based alloy material, but also an Al-$CuAl_2$ based alloy material, an Al-$Mg_2Si$ based alloy material, an Al-AlFeSi intermetallic compound based alloy material and the like.

[Embodiment II]

Table 6 shows the composition and the density of new examples A, B, C, D, E and F of aluminum alloy materials. The examples A to F are materials cut away from a long continuous material having a high quality and made in a continuous casting process. In casting them, the spheroidization of α-Al was performed. Each of the examples A to F had a diameter of 50 mm and a length of 65 mm.

TABLE 6

| Example of Al alloy material | Chemical constituent (% by weight) $Mg_2Si$ | Mg | Si | Cu | Balance | Density (g/cm³) |
|---|---|---|---|---|---|---|
| A | 1.0 | 0.8 | 0.4 | 0.4 | Al | 2.7 |
| B | 2.3 | 1.4 | 0.9 | 1.9 | Al | 2.69 |
| C | 7.9 | 4.8 | 3.1 | 2.1 | Al | 2.67 |
| D | 11.0 | 6.4 | 4.1 | 1.8 | Al | 2.63 |

TABLE 6-continued

| Example of Al alloy material | Chemical constituent (% by weight) $Mg_2Si$ | Mg | Si | Cu | Balance | Density (g/cm³) |
|---|---|---|---|---|---|---|
| E | 13.7 | 8.2 | 5.5 | 1.4 | Al | 2.58 |
| F | 26.2 | 16.0 | 10.8 | 2.3 | Al | 2.48 |

Figure 10:
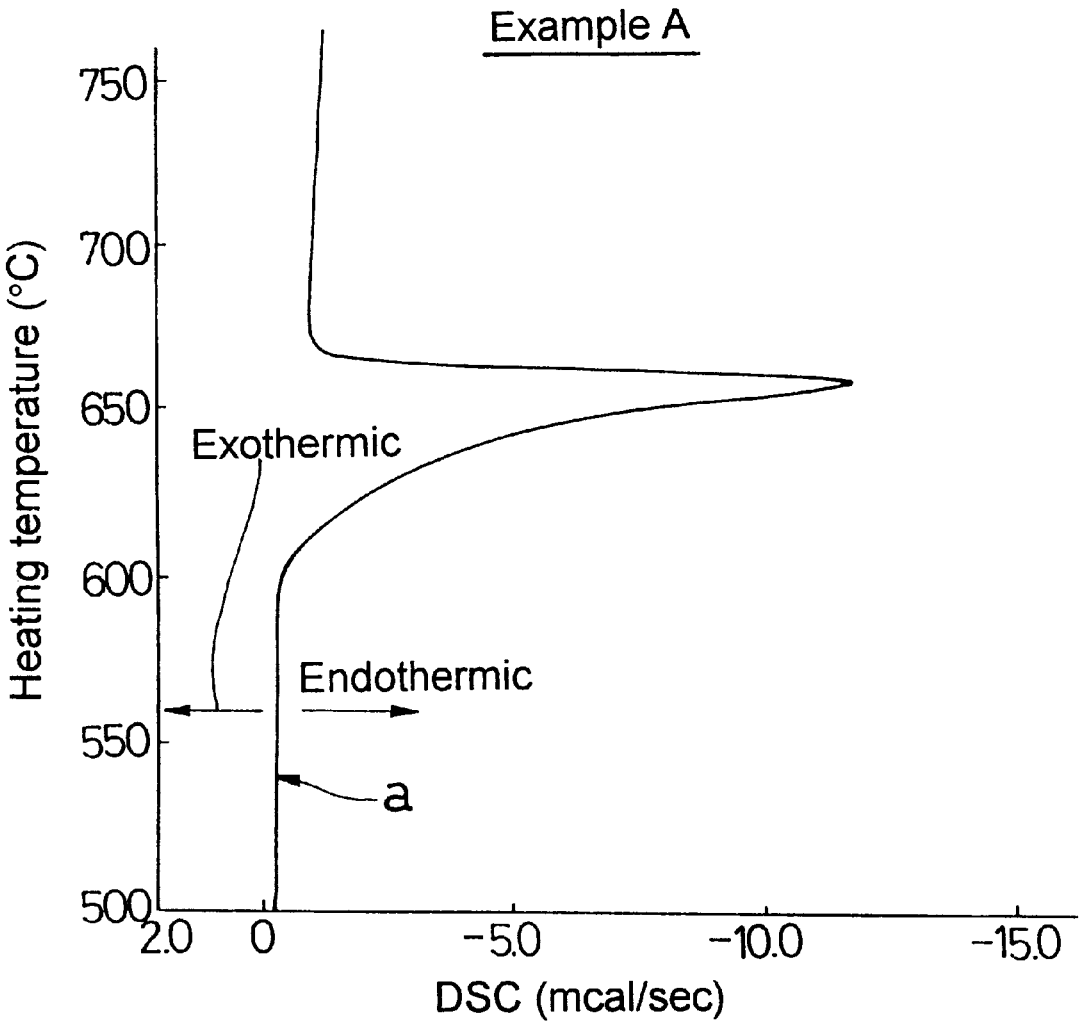
FIG. 10 is a differential calorimetric curve for an example A of an aluminum alloy material.

The example A was subjected to a differential scanning calorimetry (DSC) to provide a result shown in FIG. 10. Only a single angled endothermic section appears in a differential calorimetric curve a shown in FIG. 10.

Figure 11:
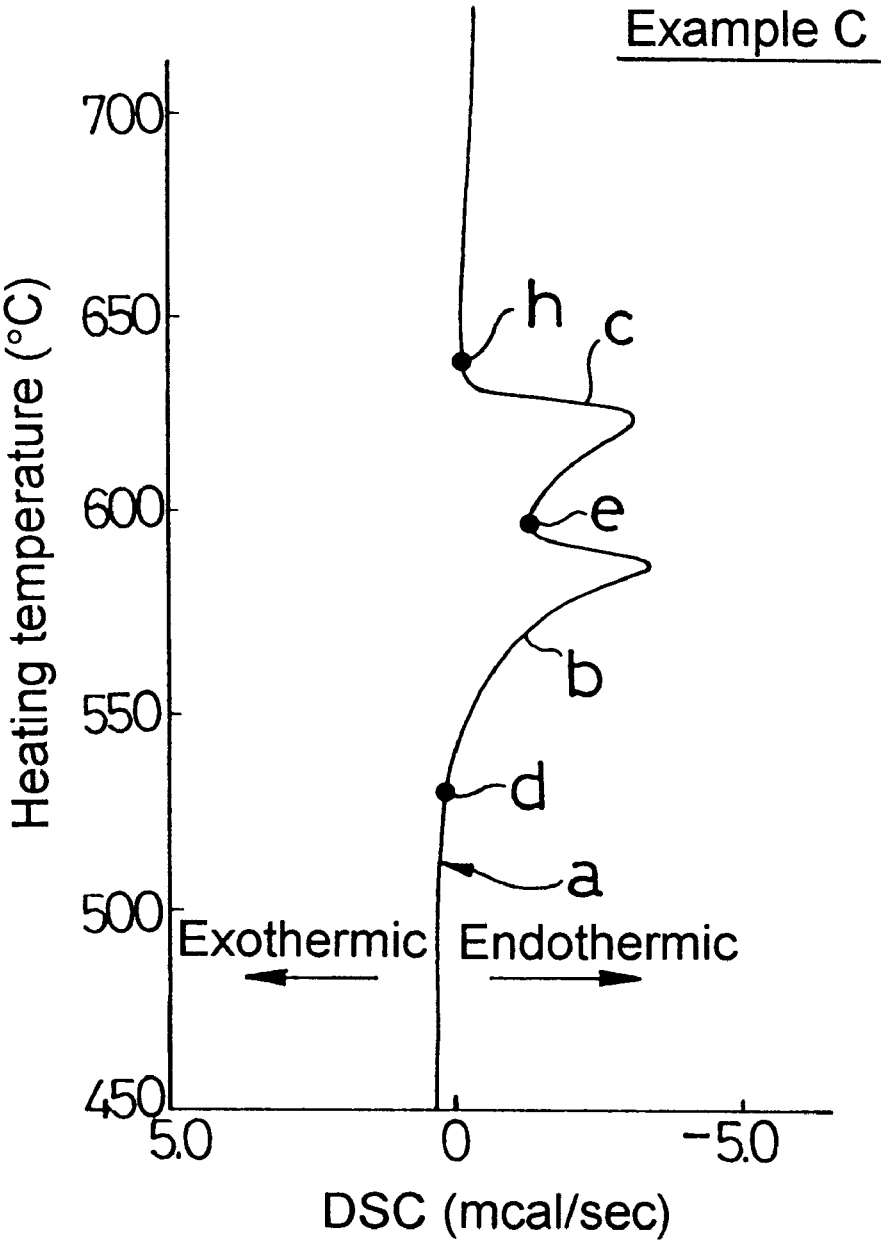
FIG. 11 is a differential calorimetric curve for an example C of an aluminum alloy material.

FIG. 11 shows a differential calorimetric curve for an example C. A first angled endothermic section b appearing due to the melting of a eutectic crystal and a second angled endothermic section c appearing due to the melting of a component having a melting point higher than a eutectic point exist in the differential calorimetric curve. The temperature of a rise-start point d in the first angled endothermic section b is a melt-start temperature (a solidification-end temperature) of the eutectic component, and the temperature of a drop-end point e in the first angled endothermic section b (a rise-start point of the second angle endothermic section c) is a melt-end temperature of the eutectic component (a melt-start temperature of the high-melting component). Further, the temperature of a drop-end point h in the second angled endothermic section c is a melt-end temperature (a solidification-start temperature) of the high-melting component.

The aluminum alloy material example A was placed into the heating coil in the induction heating device and then heated under conditions of a frequency of 1 kHz and a maximum output power of 37 kW to prepare an example A of a semi-molten aluminum alloy material having solid and liquid phases coexisting therein.

Thereafter, as shown in FIG. 1, the semi-molten aluminum alloy material example A was placed into the chamber 6. A primary pressing step for the example A was started under conditions of a casting temperature of 640° C., a solid phase rate of 40%, a moving speed of the pressing plunger 9 of 0.5 m/sec, a gate-passing speed of the example A of 0.8 m/sec and a mold temperature of 250° C., and the example A was forced through the gate 7 into the cavity 4 while being pressed. The plunger pressure at the completion of the primary pressing step was set at 360 kgf/cm$^2$.

After completion of the primary pressing step, a secondary pressing step for the example A was immediately started. In the secondary pressing step, the example A was solidified to provide an example A of an aluminum alloy cast product. The plunger pressure in the secondary pressing step was set at 760 kgf/cm$^2$, and the pressing retention time was set at 30 sec.

Then, the thixocasting process was carried out in the same manner, except that the solid phase rate S (volume fraction rate of the solid phase to the total volume of the solid and liquid phases) of the aluminum alloy material example A was varied to 5% and 10%; the solid phase rate S of examples B, C and D was varied to 5%, 10% and 40% and the solid phase rate S of examples E and F was set at 40%, thereby producing various examples $A_2$, $A_3$, $B_1$, $B_2$, $B_3$, $C_1$, $C_2$, $C_3$, $D_1$, $D_2$, $D_3$, $E_1$ and $F_1$ of aluminum alloy cast products. These examples $A_2$, $A_3$, $B_1$, $B_2$, $B_3$, $C_1$, $C_2$, $C_3$, $D_1$, $D_2$, $D_3$, $E_1$ and $F_1$ correspond to the aluminum alloy material examples A to F, respectively.

Further, using the aluminum alloy material examples A to F, a gravity casting was carried out at a pouring temperature of 700° C. and a mold temperature of 100° C. to produce various aluminum alloy cast product examples $A_4$ to $F_4$ (in this case, the solid phase rate S of the examples A to F was 0%). These examples $A_4$ to $F_4$ correspond to the examples A to F, respectively.

Tensile test pieces were fabricated from the aluminum alloy cast product examples $A_1$ to $A_4$, $B_1$ to $B_4$, $C_1$ to $C_4$, $D_1$ to $D_4$, $E_1$, $E_4$, $F_1$ and $F_4$ and subjected to a tensile test to measure the ultimate strength, thereby providing results shown in Table 7.

TABLE 7

| Al alloy cast product | | Solid phase rate S of semi-molten Al alloy material | | | | | | | |
|---|---|---|---|---|---|---|---|---|---|
| | | 40% | | 10% | | 5% | | 0% | |
| Example | $Mg_2Si$ content (% by weight) | Ultimate strength (MPa) | | Ultimate strength (MPa) | | Ultimate strength (MPa) | | Ultimate strength (MPa) | |
| $A_1$ to $A_4$ | 1.0 | $A_1$ | 287 | $A_2$ | 278 | $A_3$ | 269 | $A_4$ | 260 |
| $B_1$ to $B_4$ | 2.3 | $B_1$ | 370 | $B_2$ | 310 | $B_3$ | 298 | $B_4$ | 285 |
| $C_1$ to $C_4$ | 7.9 | $C_1$ | 375 | $C_2$ | 308 | $C_3$ | 296 | $C_4$ | 285 |
| $D_1$ to $D_4$ | 11.0 | $D_1$ | 370 | $D_2$ | 300 | $D_3$ | 296 | $D_4$ | 275 |
| $E_1$, $E_4$ | 13.7 | $E_1$ | 264 | — | | — | | $E_4$ | 269 |
| $F_1$, $F_4$ | 26.2 | $F_1$ | 217 | — | | — | | $F_4$ | 216 |

Figure 12:
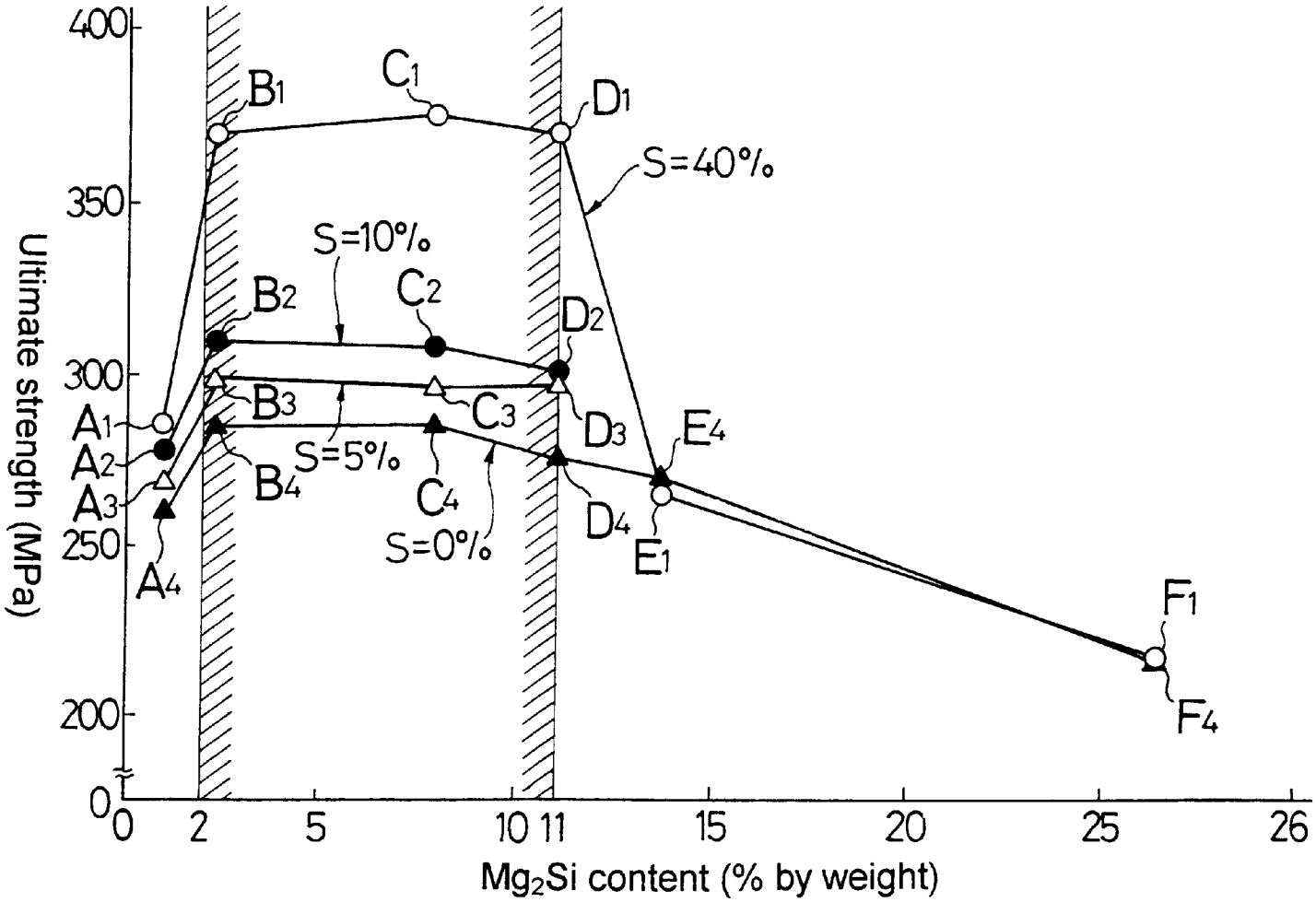
FIG. 12 is a graph illustrating the relationship between the $Mg_2Si$ content and the ultimate strength.

FIG. 12 is a graph taken from Table 7 and showing the relationship between the $Mg_2Si$ content and the ultimate strength. In FIG. 12, It can be generally mentioned that the aluminum alloy cast product made by the thixocasting process has a strength higher than that of the aluminum alloy cast product made by the gravity casting process, but the aluminum alloy cast product examples $E_1$ and $E_4$ as well as $F_1$ and $F_4$ having the $Mg_2Si$ content larger than 11% by weight have substantially equivalent strengths. This is for the following reason: In the case of the examples $E_1$ ($F_1$), the amount of hydrogen dissolved is small, but the amount presence of the brittle $Mg_2Si$ is large. On the other hand, in the case of the example $E_4$ ($F_4$), the amount of hydrogen dissolved is large. Due to these facts, the strengths of the examples $E_1$ ($F_1$) and the example $E_4$ ($F_4$) are decreased and substantially equal to each other.

Figure 13:
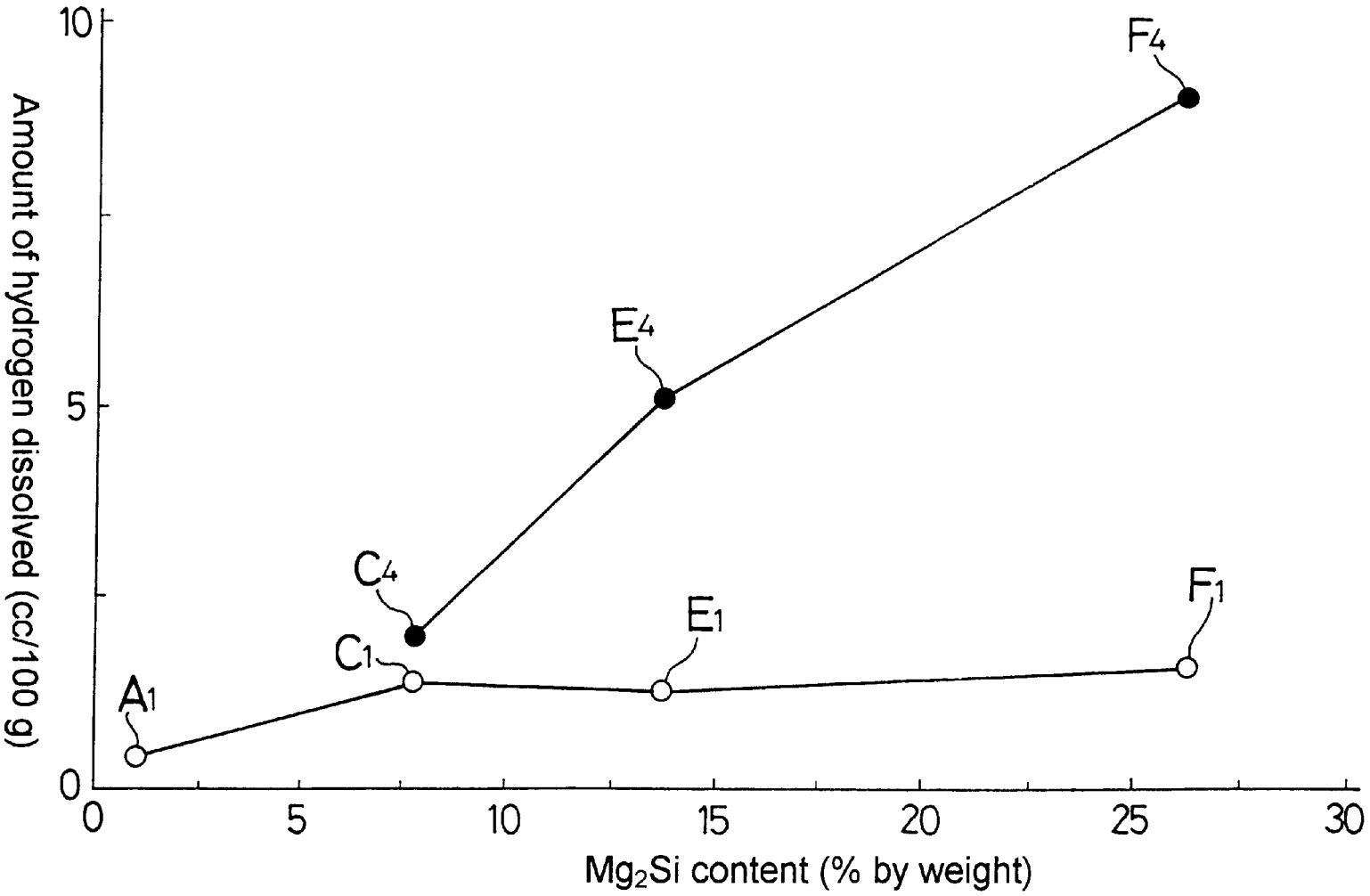
FIG. 13 is a graph illustrating the relationship between the $Mg_2Si$ content and the amount of hydrogen dissolved.

FIG. 13 shows the relationship between the $Mg_2Si$ content and the amount of hydrogen dissolved for the aluminum alloy cast product examples $A_1$, $C_1$, $E_1$ and $F_1$ produced using the semi-molten aluminum alloy material examples A, C, E and F having the solid phase rate S equal to 40% and the aluminum alloy cast product examples $C_4$, $E_4$ and $F_4$ produced by the gravity casting process using the aluminum alloy material examples C, E and F having the solid phase rate equal to 0%, i.e., molten metals thereof. It can be seen from FIG. 13 that at the same $Mg_2Si$ content, the amount of hydrogen dissolved in the aluminum alloy cast product examples $C_1$, $E_1$ and $F_1$ produced by the thixocasting process is smaller than that in the aluminum alloy cast product examples $C_4$, $E_4$ and $F_4$ produced by the gravity casting.

Figure 14:
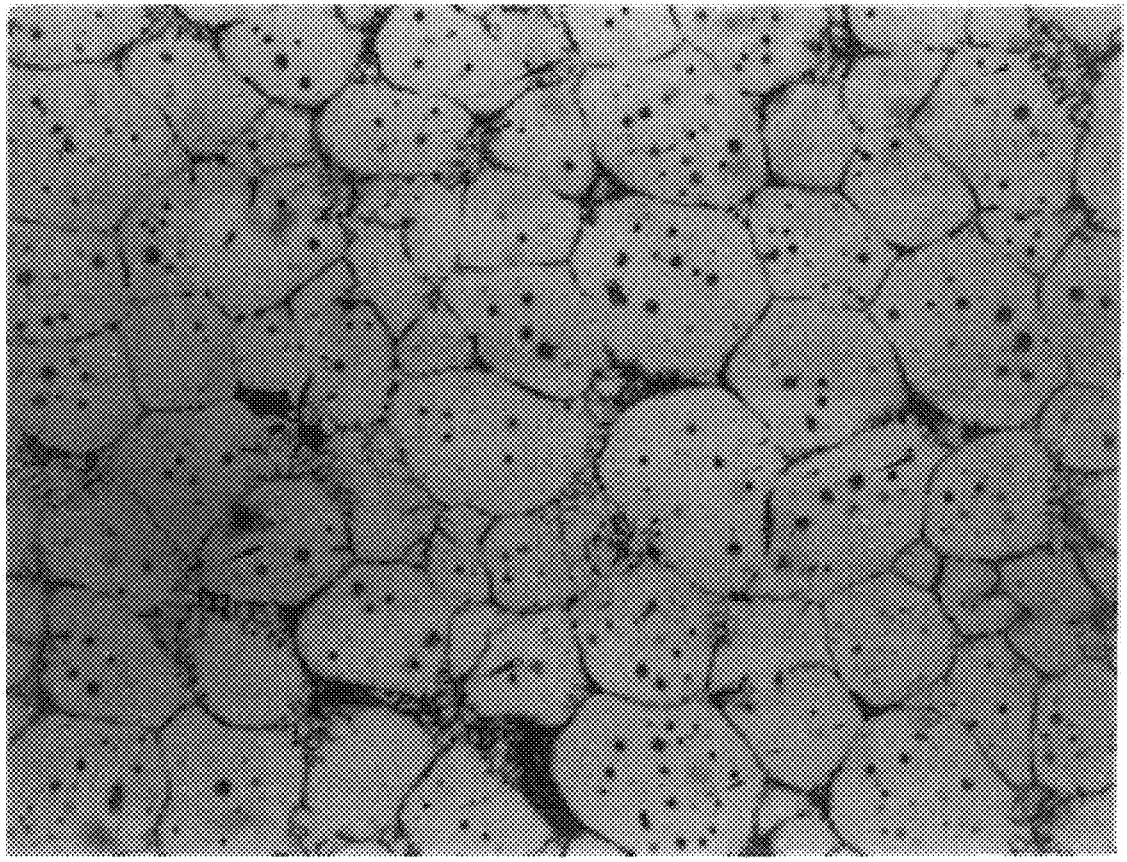
FIG. 14 is a photomicrograph showing the metallographic structure of the example $A_1$ of the aluminum alloy material.

FIG. 14 is a photomicrograph showing the metallographic structure of the aluminum alloy cast product example $A_1$ produced using the semi-molten aluminum alloy material having the solid phase rate S equal to 40%. It can be seen from FIG. 14 that a shrinkage cavity (a black area) was produced around the spherical α-Al. This is due to the fact that the liquid phase was not supplied sufficiently to portions around the solid phase in the semi-molten aluminum alloy material example $A_1$.

Figure 15A:
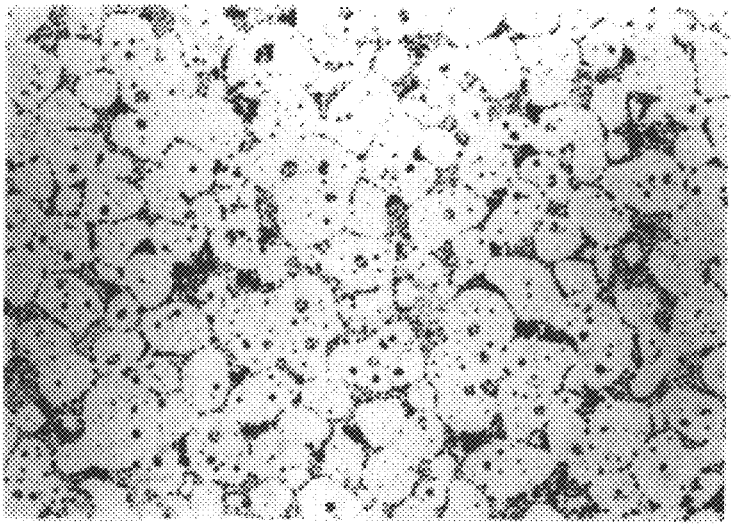
FIG. 15A is a photomicrograph showing the metallographic structure of an example $C_1$ of an aluminum alloy cat product.
Figure 15B:
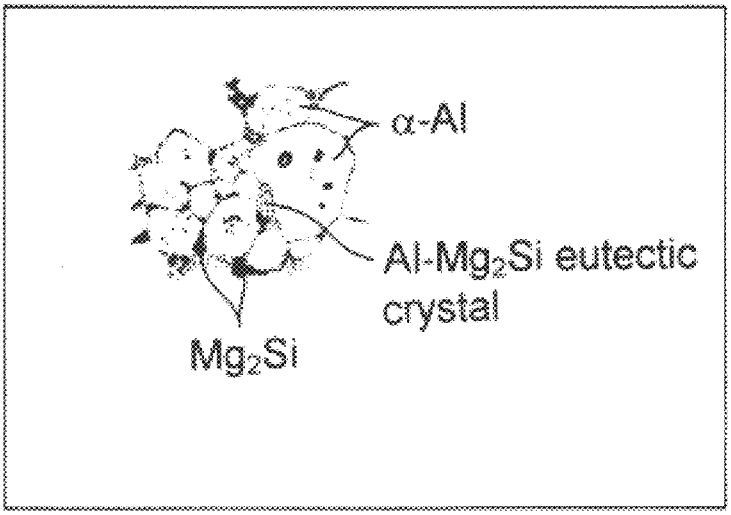
FIG. 15B is a tracing of an essential portion of FIG. 15A.

FIG. 15A is a photomicrograph showing the metallographic structure of the aluminum alloy cast product example $C_1$ produced using the semi-molten aluminum alloy material example C having the solid phase rate equal to 40%, and FIG. 15B is a tracing of an essential portion of FIG. 15A. It can be seen from FIGS. 15A and 15B that no shrinkage cavity and no blow holes are produced in the aluminum alloy cast product example $C_1$, and the $Mg_2Si$ was finely divided and was of a suitable presence amount and thus, the aluminum alloy cast product example $C_1$ has a good casting quality. This is attributable to the fact that since the $Mg_2Si$ content in the semi-molten aluminum alloy cast product example C was set in the range of 2% by weight $\leqq Mg_2Si \leqq 11\%$ by weight, the liquid phase was sufficiently supplied to around the solid phase and the amount of hydrogen dissolved in the liquid phase was small.

Figure 16A:
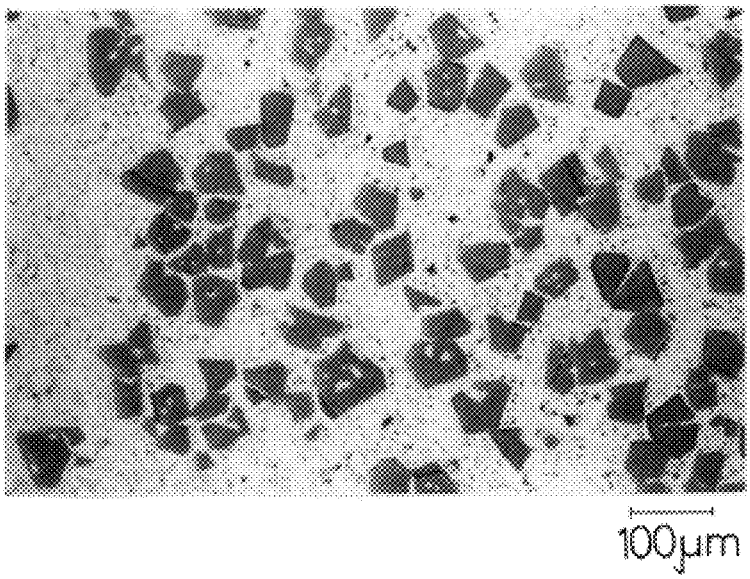
FIG. 16A is a photomicrograph showing the metallographic structure of an example $F_1$ of an aluminum alloy cast product.
Figure 16B:
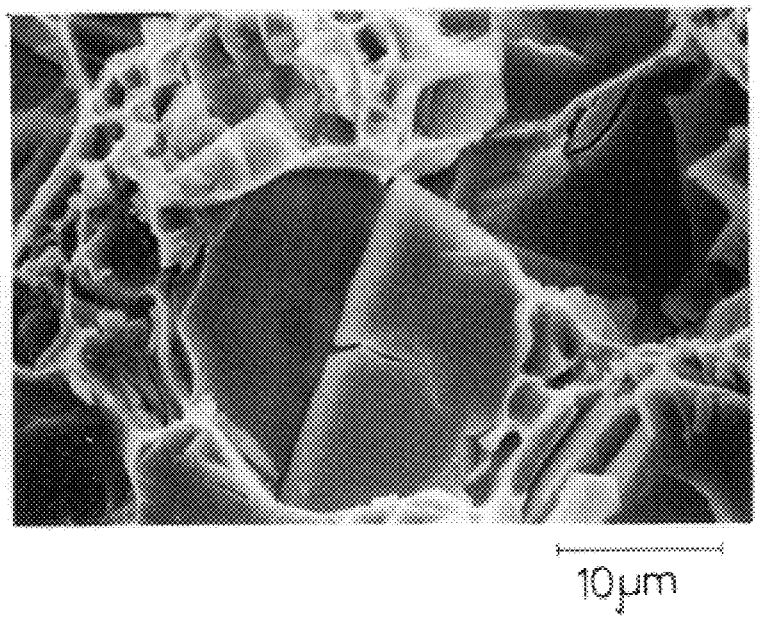
FIG. 16B is an enlarged photomicrograph of an essential portion of FIG. 16A.

FIGS. 16A and 16B are photomicrographs showing the metallographic structure of the aluminum alloy cast product example $F_1$ produced using the semi-molten aluminum alloy material having the solid phase rate equal to 40%. It can be observed in FIG. 16A that $Mg_2Si$ is a dark gray massive portion and exists in a large amount. It can be observed in FIG. 16B that $Mg_2Si$ is a large massive portion and is brittle and hence, has cracks produced. The cracks appear as black lines in some $Mg_2Si$ in FIG. 16A.

Figure 17:
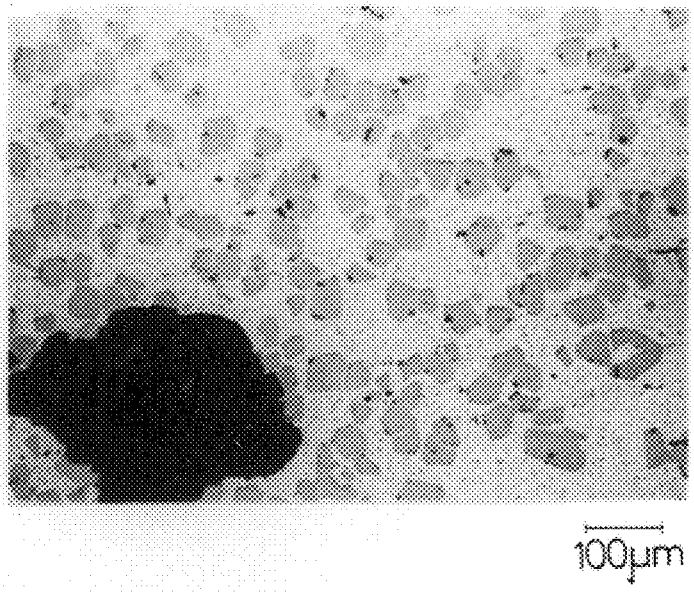
FIG. 17 is a photomicrograph showing the metallographic structure of an example $F_4$ of an aluminum alloy cast product.

FIG. 17 is a photomicrograph showing the metallographic structure of the aluminum alloy cast product example $F_4$ produced by the gravity casting process using the aluminum alloy material example F having the solid phase rate S equal to 0%, i.e., the molten metal thereof. Blow holes (black portions) were produced in the aluminum alloy cast product example $F_4$ due to a large amount of hydrogen dissolved.

Figure 18:
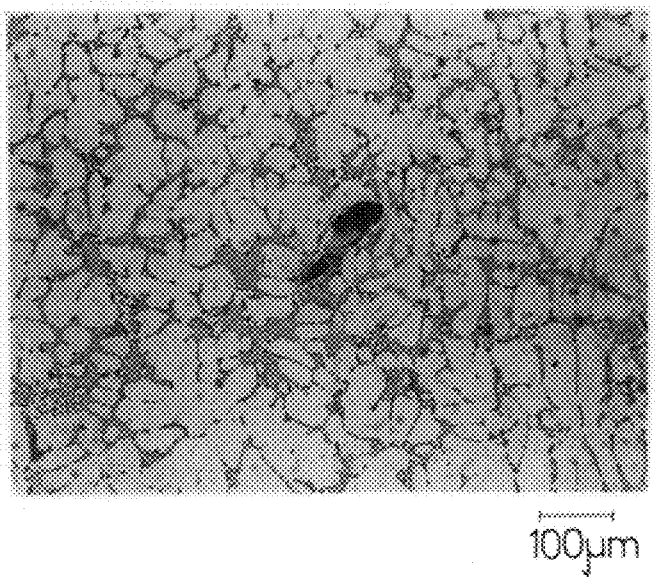
FIG. 18 is a photomicrograph showing the metallographic structure of an example $C_4$ of an aluminum alloy cast product.

FIG. 18 is a photomicrograph showing the metallographic structure of the aluminum alloy cast product example $C_4$ produced by the gravity casting process using the molten metal of the aluminum alloy material example C (having the solid phase rate S equal to 0%). Blow holes (black portions) were also produced in the aluminum alloy cast product example $C_4$, as in the aluminum alloy cast product example $F_4$ shown in FIG. 17.

As apparent from the above results, by using the aluminum alloy material having the $Mg_2Si$ content in the range of 2% by weight $\leqq Mg_2 \leqq 11\%$ by weight in carrying out the thixocasting process, an aluminum alloy cast product having no casting defects generated and having a high strength and a light weight can be produced.

It is preferable from the FIG. 12 that to decrease the amount of hydrogen dissolved in the semi-molten aluminum alloy material to reliably enhance the strength of the aluminum alloy cast product, the solid phase rate S of the material is set in the range of $S \geqq 10\%$.

[Embodiment III]

Figure 19:
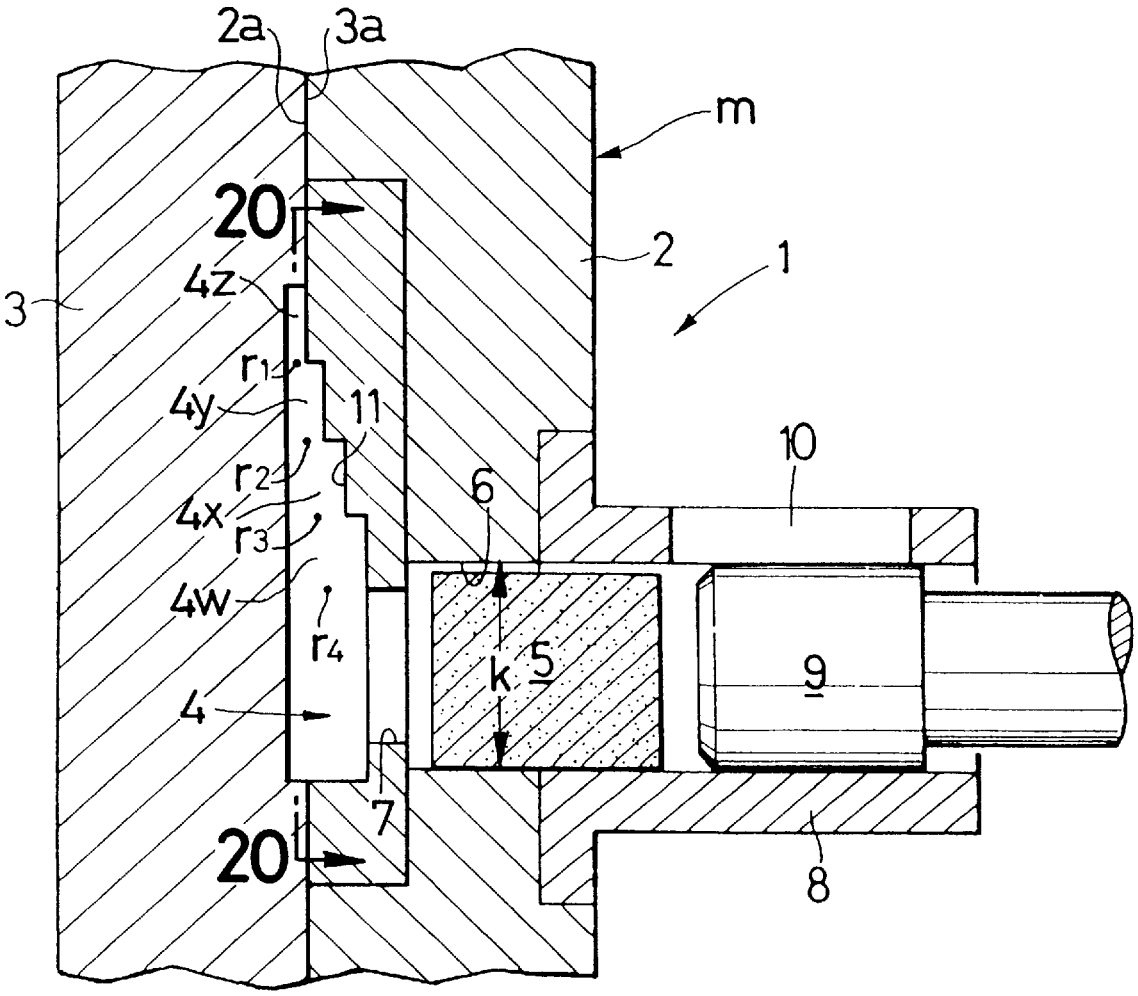
FIG. 19 is a longitudinal sectional front view of another example of a pressure casting machine.
Figure 20:
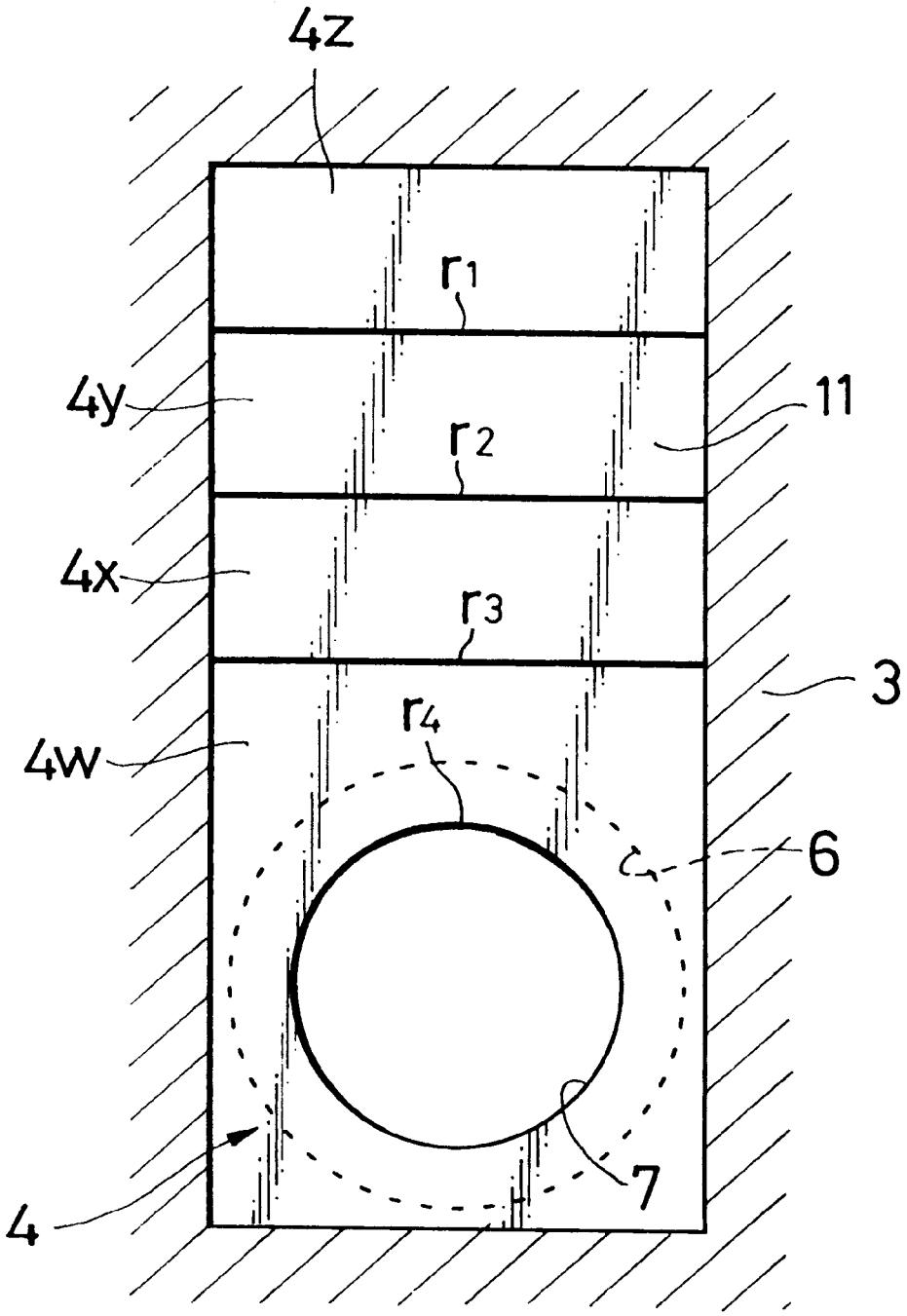
FIG. 20 is a sectional view taken along a line 20—20 in FIG. 19.

A cavity 4 in a casting mold m in a pressure casting machine shown in FIGS. 19 and 20 is of a rectangular parallelepiped shape with a long side extending vertically and is formed so that the volume is stepwise decreased from the below to the above by a stepped surface 11 located on a mating face 2*a* of a stationary die 2. The other structures are the same as in the pressure casting machine 1 shown in FIG. 1 and hence, the same components are designated by like reference characters in FIGS. 19 and 20.

EXAMPLE 1

Table 8 shows the compositions of aluminum alloy material examples $A_1$, $A_2$ and $A_3$ and examples $B_1$ and $B_2$ for comparison. The examples $A_1$, $A_2$, $A_3$, $B_1$ and $B_2$ are materials cut away from a long continuous casting material made in a continuous casting process and having a high quality. In the casting thereof, the spheroidization of α-Al was performed. Each of the examples $A_1$, $A_2$, $A_3$, $B_1$ and $B_2$ has a diameter of 50 mm and a length of 65 mm. In this case, the inside diameter k of the chamber 6 is equal to 55 mm.

TABLE 8

| Example of aluminum alloy material | Chemical constituent (% by weight) | | | | |
|---|---|---|---|---|---|
| | Si | Mg | Fe | Sr(ppm) | Balance |
| $A_1$ | 7.10 | 0.46 | 0.10 | 3 | Balance |
| $A_2$ | 7.05 | 0.50 | 0.09 | 20 | Balance |
| $A_3$ | 7.00 | 0.57 | 0.10 | 100 | Balance |
| $B_1$ | 6.90 | 0.52 | 0.11 | 172 | Balance |
| $B_2$ | 7.00 | 0.57 | 0.10 | 336 | Balance |

First, the example $A_1$ was placed into the heating coil in the induction heating device and then heated under conditions of a frequency of 1 kHz and a maximum output power of 30 kW to prepare an example $A_1$ of a semi-molten aluminum alloy material having solid and liquid phases coexisting therein. In this case, the solid phase rate was set at 45%.

Thereafter, as shown in FIG. 19, the example $A_1$ of the semi-molten aluminum alloy material 5 was placed into the chamber 6 forced through the gate 7 into the cavity 4 while being pressed under conditions of a casting temperature of the example $A_1$ of 580° C., a moving speed of the plunger 9 of 0.20 m/sec, a casting pressure of 800 kgf/(sec.cm$^2$) and a mold temperature of 250° C. A pressing force was applied to the example $A_1$ filled in the cavity 4 by retaining the pressing plunger 9 at a stroke terminate end, so that the example $A_1$ was solidified under pressure to produce an aluminum alloy cast product example $A_1$. After casting, the aluminum alloy cast product example $A_1$ was subjected to a T6 treatment (this applies to an aluminum alloy cast product which will be described hereinafter in this embodiment III).

Figure 21:
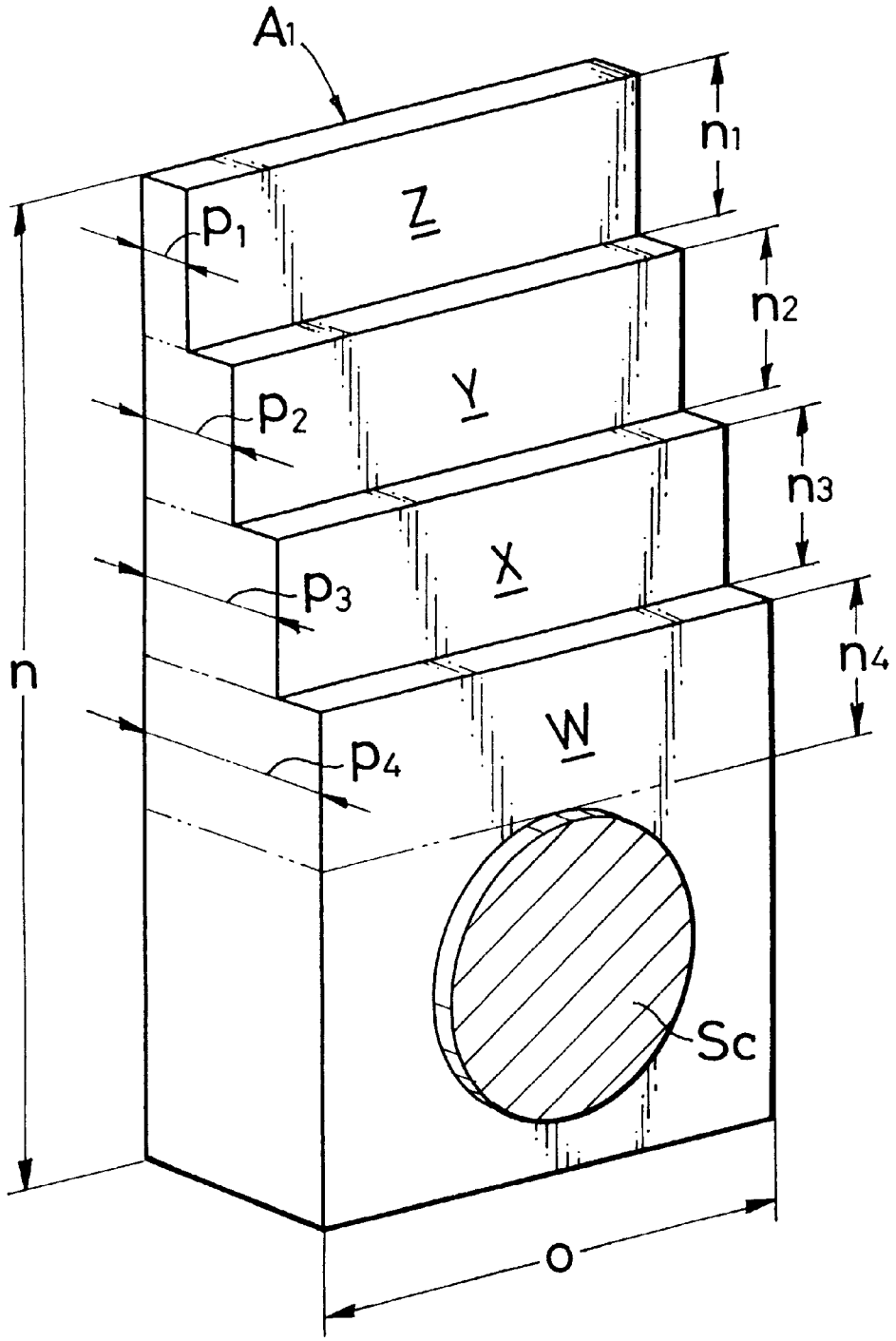
FIG. 21 is a perspective view of an aluminum alloy cast product.

FIG. 21 shows the aluminum alloy cast product example $A_1$. The sizes of portions of the example $A_1$ are as follows: The entire length n=130 mm; the entire width=60 mm; the length $n_1$ of a tip end Z=20 mm and the thickness $p_1$ thereof =5 mm; the length $n_2$ of a first intermediate portion Y=20 mm and the thickness $p_2$ thereof =10 mm; the length of a second intermediate portion X=20 mm and the thickness $p_3$ thereof =15 mm; and the length $n_4$ of a base end W located between the second intermediate portion X and a scrap portion Sc corresponding to the gate 7=20 mm and the thickness $p_4$ thereof =20 mm.

Figure 22:
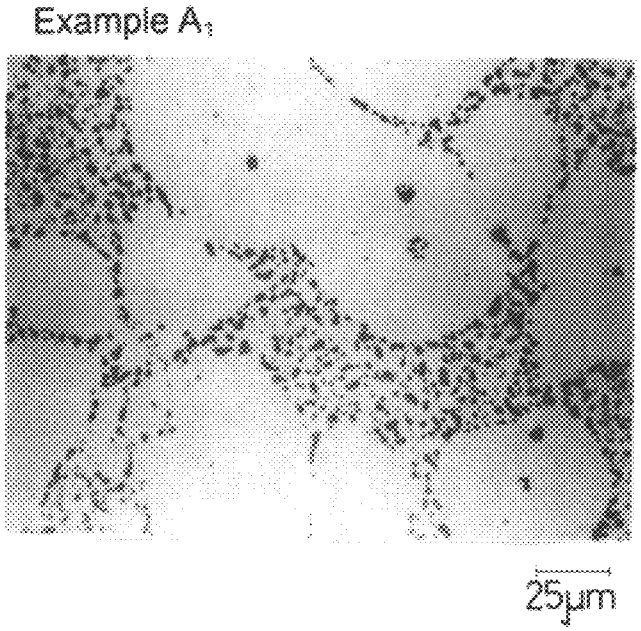
FIG. 22 is a photomicrograph showing the metallographic structure of the example $A_1$ of the aluminum alloy cast product.

FIG. 22 is a photomicrograph showing the metallographic structure of the first intermediate portion Y of the aluminum alloy cast product example $A_1$ after the T6 treatment. In FIG. 22, a relatively large and rounded portion is a dispersion phase formed by the solidification of the solid phase, namely, an α-Al phase, and a portion filling an area between the dispersion phases is a matrix formed by the solidification of the liquid phase. The matrix is comprised of an infinite number of black dot-like Al-Si eutectic crystal phases, and α-Al phases filling the areas between the Al-Si eutectic crystal phases. It can be seen from FIG. 22 that the metallographic structure of the matrix was finely divided, and the matrix and the dispersion phases were sufficiently in contact with each other.

The casting operation was carried out in the same manner using examples $A_2$ and $A_3$ and examples $B_1$ and $B_2$, thereby producing four aluminum alloy cast product examples $A_2$, $A_3$, $B_1$ and $B_2$ having the same shape as the aluminum alloy cast product example $A_1$.

Table 9 shows the flow speed V and the shear rate Rs in shaping the portions W to Z as well as the Charpy impact value C and the fracture toughness value $K_{IC}$ for the aluminum alloy cast product examples $A_1$, $A_2$, $A_3$, $B_1$ and $B_2$.

The flow speeds V for the tip end Z, the first and second intermediate portions Y and X and the base end W were measured at entrances $r_1$, $r_2$, $r_3$ and $r_4$ of a tip end shaping zone 4*x*, first and second intermediate portion shaping zone 4*y* and 4*w* and a base end shaping zone 4*z* in the cavity 4, as shown in FIG. 19, immediately before the completion of the pouring of the examples $A_1$ and the like into the cavity 4. The shear rate Rs was determined according to Rs=V/(p/2) wherein V represents the flow speed, and p represents the width of the shaping zones 4*z* to 4*w* and thus, the thickness of the portions Z to W (p is $p_1$, $p_2$, $p_3$ and $p_4$).

TABLE 9

| Example of Al alloy cast product | Portion | Flow rate V (m/sec) | Shear rate Rs ($s^{-1}$) | Charpy impact value C ($J/cm^2$) | Fracture toughness value $K_{IC}$ ($MPa \cdot m^{1/2}$) |
|---|---|---|---|---|---|
| $A_1$ | W | 0.40 | 40 | 3.0 | 15.0 |
| Sr = 3 ppm | X | 0.53 | 71 | 4.8 | 24.2 |
| | Y | 0.79 | 158 | 8.5 | 32.5 |
| | Z | 1.58 | 632 | 9.2 | 34.5 |
| $A_2$ | W | 0.40 | 40 | 3.2 | 16.0 |
| Sr = 20 ppm | X | 0.53 | 71 | 4.6 | 23.4 |
| | Y | 0.79 | 158 | 7.8 | 31.2 |
| | Z | 1.58 | 632 | 8.5 | 32.7 |
| $A_3$ | W | 0.40 | 40 | 3.5 | 16.5 |
| Sr = 100 ppm | X | 0.53 | 71 | 4.0 | 21.6 |
| | Y | 0.79 | 158 | 4.2 | 22.8 |
| | Z | 1.58 | 632 | 4.1 | 22.3 |
| $B_1$ | W | 0.40 | 40 | 3.3 | 17.9 |
| Sr = 172 ppm | X | 0.53 | 71 | 3.6 | 18.5 |
| | Y | 0.79 | 158 | 3.7 | 18.3 |
| | Z | 1.58 | 632 | 3.7 | 18.6 |
| $B_2$ | W | 0.40 | 40 | 3.6 | 17.8 |
| Sr = 336 ppm | X | 0.53 | 71 | 3.7 | 17.2 |
| | Y | 0.79 | 158 | 3.6 | 18.7 |
| | Z | 1.58 | 632 | 3.7 | 18.0 |

Figure 23:
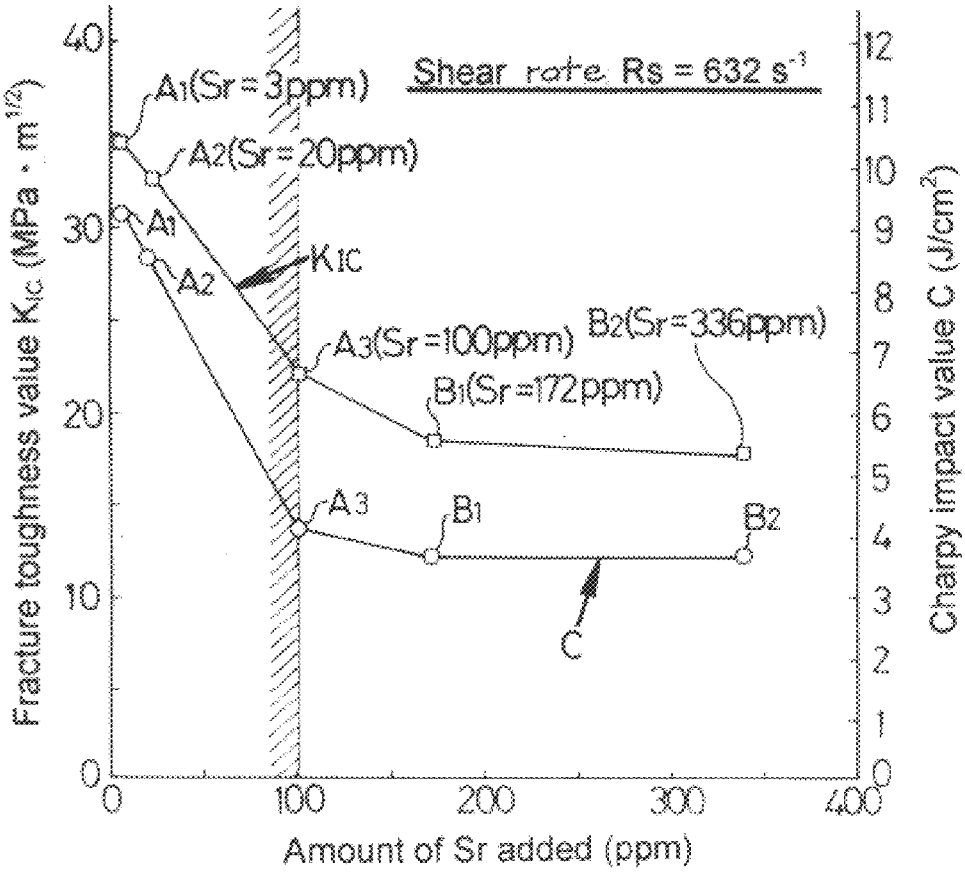
FIG. 23 is a graph showing the amount of Sr added and the fracture toughness value $K_{IC}$ as well as the Charpy impact value C.

FIG. 23 is a graph taken from Table 9 and showing the relationship between the amount of Sr added and the Charpy impact value C as well as the fracture toughness value $K_{IC}$ for the tip ends Z of the aluminum alloy cast product examples $A_1$, $A_2$, $A_3$, $B_1$ and $B_2$. It can be seen from FIG. 23 that if the amount of Sr added is set in a range of Sr≦100 ppm as in the examples $A_1$, $A_2$ and $A_3$, the toughness of the aluminum alloy cast product examples $A_1$, $A_2$ and $A_3$ is largely enhanced.

Figure 24:
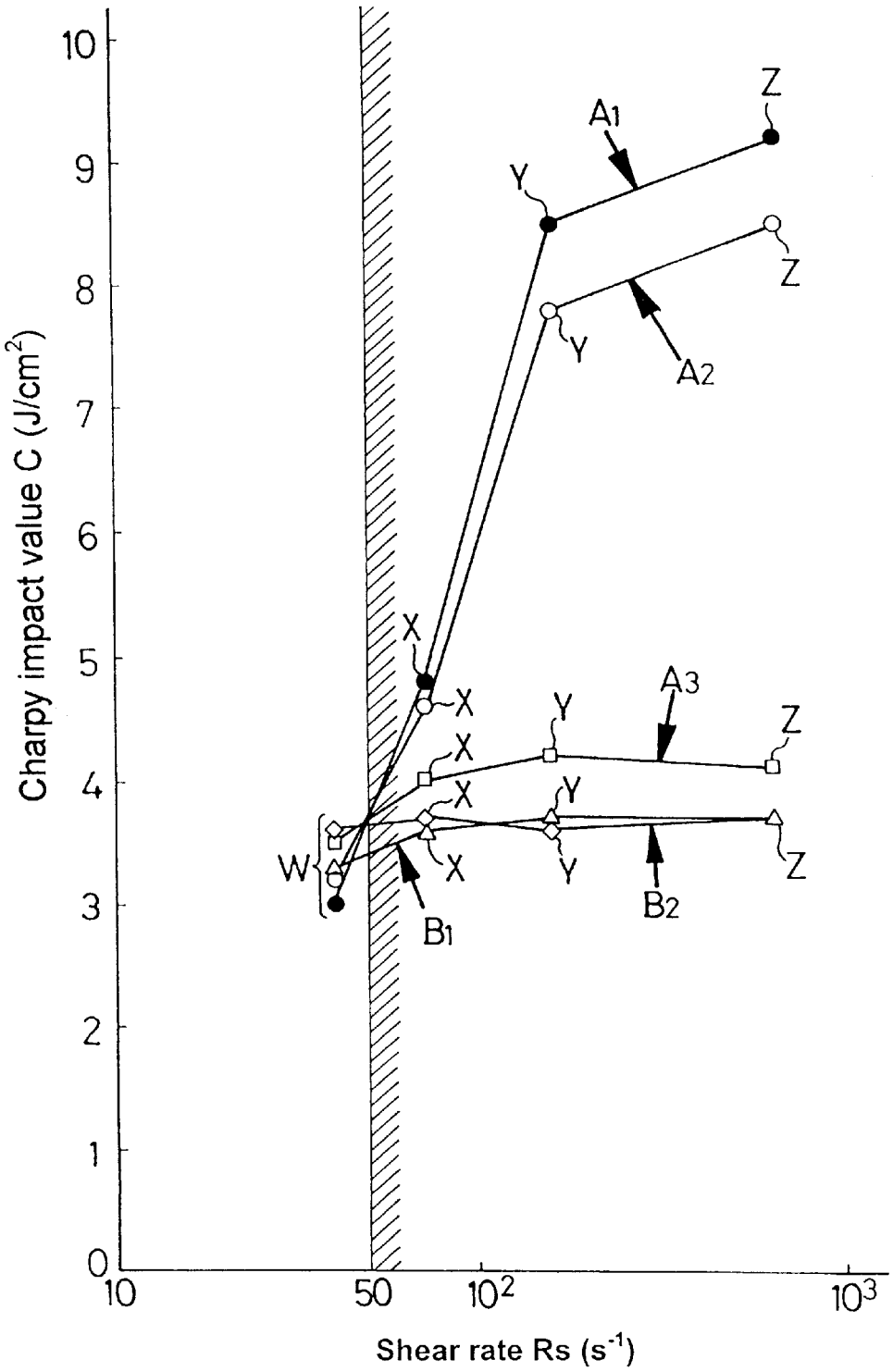
FIG. 24 is a graph showing an example of the relationship between the shear rate Rs and the Charpy impact value C.

FIG. 24 is a graph taken from Table 9 and showing the relationship between the shear rate Rs and the Charpy impact value C for the portions W to Z of the aluminum alloy cast product examples $A_1$, $A_2$, $A_3$, $B_1$ and $B_2$. It can be seen from FIG. 24 that if the amount of Sr added is set in the range of Sr≦100 ppm and the shear rate Rs is set in the range of Rs≧50 $s^{-1}$ as in the examples $A_1$, $A_2$ and $A_3$, the Charpy impact value C is enhanced as in the portions X, Y and Z of the aluminum alloy cast product examples $A_1$, $A_2$ and $A_3$. If the amount of Sr is larger than 100 ppm, as in the examples $B_1$ and $B_2$, even if the shear rate Rs is set in the range of Rs≧50 $s^{-1}$, the enhancement of the Charpy impact value is not observed as in the aluminum alloy cast product examples $B_1$ and $B_2$.

Figure 25:
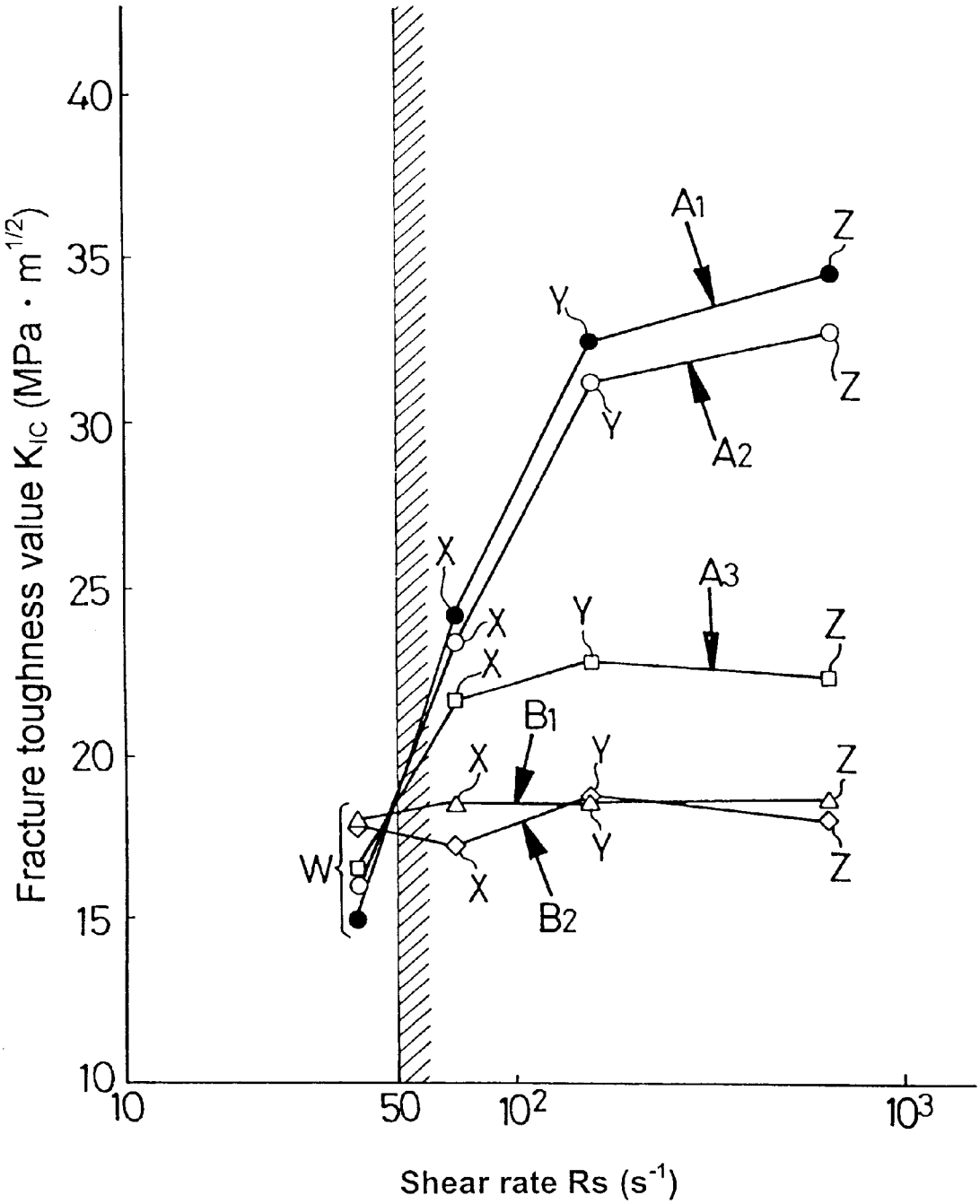
FIG. 25 is a graph showing an example of the relationship between the shear rate Rs and the fracture toughness value $K_{IC}$.

FIG. 25 is a graph taken from Table 9 and showing the relationship between the shear rate Rs and the fracture toughness value $K_{IC}$ for the portions W to Z of the aluminum alloy cast product examples $A_1$, $A_2$, $A_3$, $B_1$ and $B_2$. It can be seen from FIG. 25 that if the amount of Sr added is set in the range of Sr≦100 ppm and the shear rate Rs is set in the range of Rs≧50 $s^{-1}$, as in the examples $A_1$, $A_2$ and $A_3$, the fracture toughness value $K_{IC}$ is enhanced as in the portions X, Y and Z of the aluminum alloy cast product examples $A_1$, $A_2$ and $A_3$. If the amount of Sr added is larger than 100 ppm as in the examples $B_1$ and $B_2$, even if the shear rate Rs is set in the range of Rs≧50 $s^{-1}$, the enhancement of the fracture toughness value $K_{IC}$ is not observed as in the aluminum alloy cast product examples $B_1$ and $B_2$.

EXAMPLE 2

Table 10 shows the compositions of examples $A_4$ having a Mg content decreased from that in Example 1 and an example $B_3$ for comparison. The examples $A_4$ and $B_3$ are likewise materials cut away from a long continuous cast product made in a continuous casting process and having a high quality, and in the casting thereof, the spheroidization of α-Al was performed. Each of the examples $A_4$ and $B_3$ has a diameter of 50 mm and a length of 65 mm.

TABLE 10

| Example of aluminum alloy material | Chemical constituent (% by weight) | | | | |
|---|---|---|---|---|---|
| | Si | Mg | Fe | Sr(ppm) | Al |
| $A_4$ | 7.00 | 0.28 | 0.13 | 5 | Balance |
| $B_3$ | 7.10 | 0.30 | 0.09 | 167 | Balance |

Using the examples $A_4$ and $B_3$, the casting operation was carried out in the same manner as described above to produce two aluminum alloy cast product examples $A_4$ and $B_3$ having the same shape as the aluminum alloy cast product example $A_1$.

Table 11 shows the flow speed V and the shear rate Rs in shaping portions W to Z, and the Charpy impact value C and the fracture toughness value $K_{IC}$ of the portions W to Z in the aluminum alloy cast product examples $A_4$ and $B_3$.

TABLE 11

| Example of Al alloy cast product | Portion | Flow rate V (m/sec) | Shear rate Rs ($s^{-1}$) | Charpy impact value C ($J/cm^2$) | Fracture toughness value $K_{IC}$ ($MPa \cdot m^{1/2}$) |
|---|---|---|---|---|---|
| $A_4$ | W | 0.40 | 40 | 7.5 | 31.4 |
| Sr = 5 ppm | X | 0.53 | 71 | 9.5 | 36.5 |
| | Y | 0.79 | 158 | 11.5 | 41.6 |
| | Z | 1.58 | 632 | 13.0 | 43.6 |
| $B_3$ | W | 0.40 | 40 | 8.1 | 33.5 |
| Sr = 167 ppm | X | 0.53 | 71 | 8.5 | 32.8 |
| | Y | 0.79 | 158 | 8.2 | 34.0 |
| | Z | 1.58 | 632 | 8.3 | 33.2 |

Figure 26:
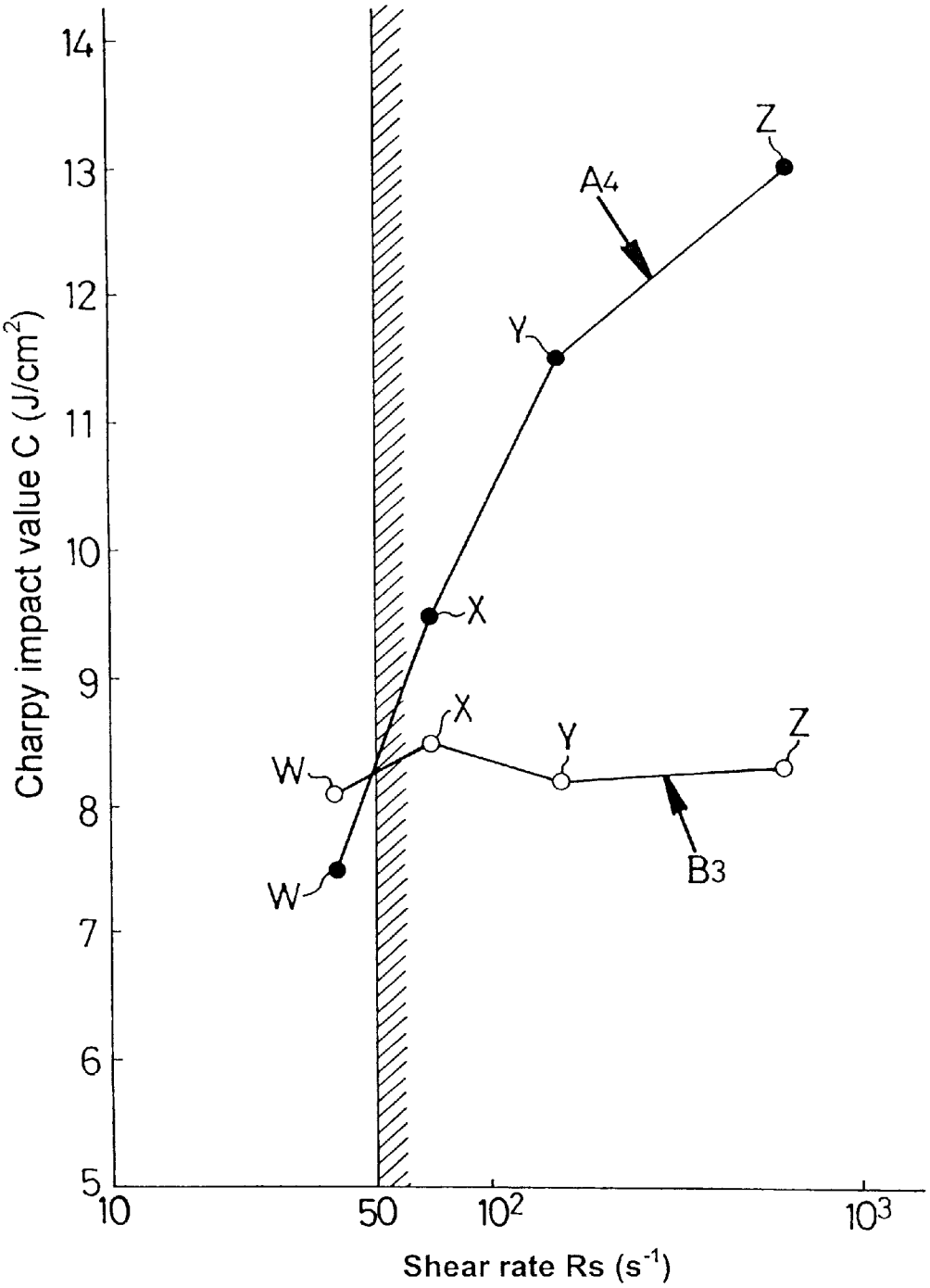
FIG. 26 is a graph showing another example of the relationship between the shear rate Rs and the Charpy impact value C.

FIG. 26 is a graph taken from Table 11 and showing the relationship between the shear rate Rs and the Charpy impact value C for the portions W to Z of the aluminum alloy cast product examples $A_4$ and $B_3$. As is apparent from FIG. 26, if the amount of Sr added is set in the range of Sr≦100 ppm and the shear rate Rs is set in the range of Rs≧50 $S^{-1}$ as in the example $A_4$, the Charpy impact value C is enhanced as in the portions X, Y and Z of the aluminum alloy cast product example $A_4$. If the amount of Sr added is larger than 100 ppm as in the example $B_3$, even if the shear rate Rs is set in the range of Rs≧50 $S^{-1}$, the enhancement of the Charpy impact value C is not observed as in the aluminum alloy cast product example $B_3$.

Figure 27:
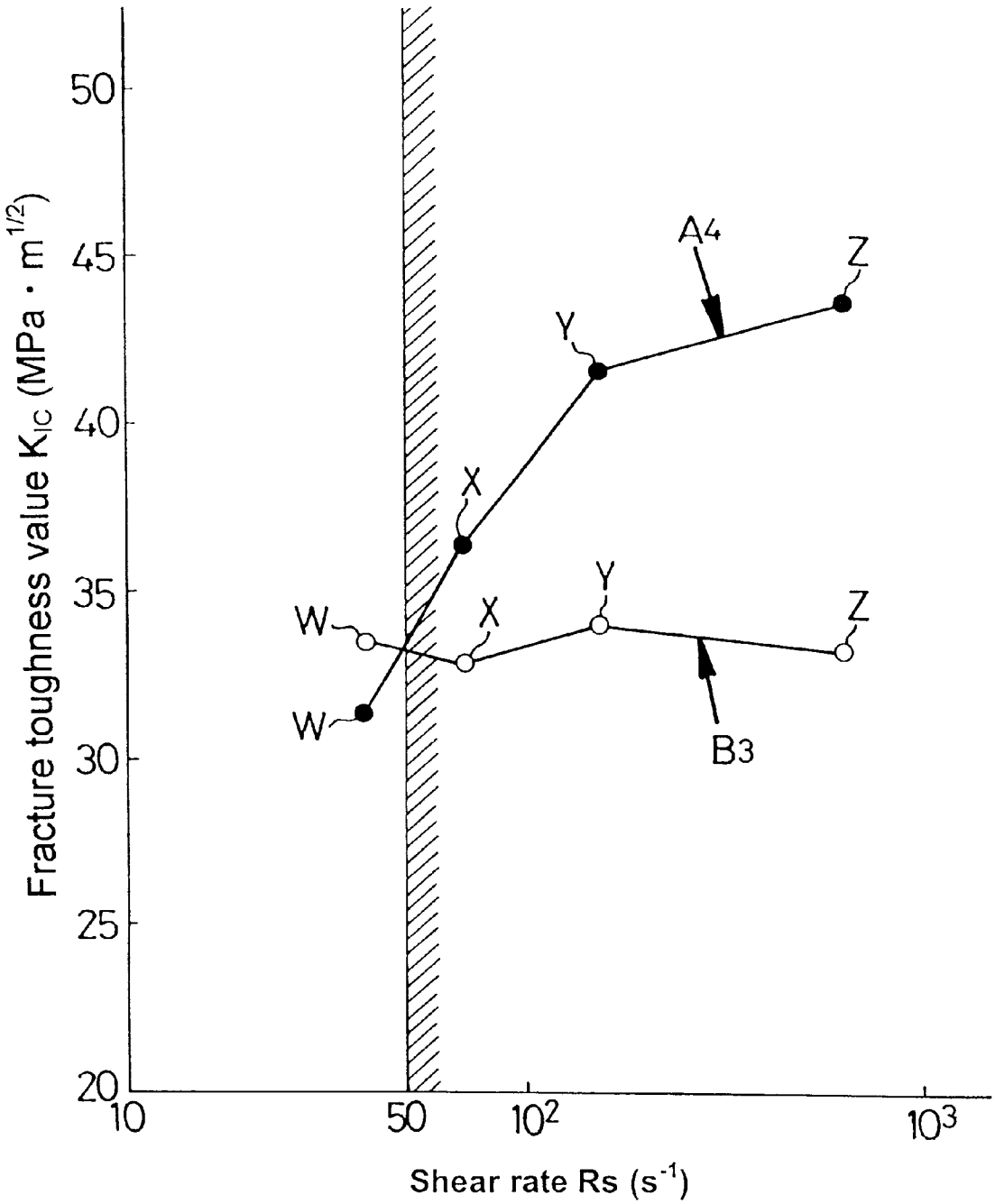
FIG. 27 is a graph showing another example of the relationship between the shear rate Rs and the fracture toughness value $K_{IC}$.

FIG. 27 is a graph taken from Table 11 and showing the relationship between the shear rate Rs and the fracture toughness $K_{IC}$ for the portions W to Z of the aluminum alloy cast product examples $A_4$ and $B_3$. As is apparent from FIG. 27, if the amount of Sr added is set in the range of Sr≦100 ppm and the shear rate Rs is set in the range of Rs≧50 $S^{-1}$ as in the example $A_4$, the fracture toughness value $K_{IC}$ is enhanced as in the portions X, Y and Z of the aluminum alloy cast product example $A_4$. If the amount of Sr added is larger than 100 ppm as in the example $B_3$, even if the shear rate Rs is set in the range of Rs≧50 $S^{-1}$, the enhancement of the fracture toughness value $K_{IC}$ is not observed in the aluminum alloy cast product example $B_3$.

[Embodiment IV]

Table 12 shows the compositions of examples $A_1$ and $A_2$ of thixocasting aluminum alloy materials and examples $B_1$, $B_2$, $B_3$ and $B_4$ for comparison. These examples $A_1$, $A_2$, $B_1$, $B_2$, $B_3$ and $B_4$ are materials cut away from a long continuous cast product made in a continuous casting process and having a high quality, and in the casting thereof, the spheroidization of α-Al was performed.

TABLE 12

| Example of aluminum alloy material | Chemical constituent (% by weight) | | | | | |
|---|---|---|---|---|---|---|
| | Si | Fe | Cu | Mn | Mg | Balance |
| $A_1$ | 17.2 | 0.25 | 4.5 | 0.02 | 0.55 | Al |
| $A_2$ | 24.6 | 0.30 | 4.2 | 0.01 | 0.56 | Al |
| $B_1$ | 7.1 | 0.15 | — | 0.01 | 0.58 | Al |
| $B_2$ | 5.3 | 0.12 | 2.9 | 0.01 | 0.30 | Al |
| $B_3$ | 6.2 | 0.82 | 3.2 | 0.05 | 0.25 | Al |
| $B_4$ | 11.2 | 0.90 | 2.1 | 0.40 | 0.12 | Al |

Figure 28:
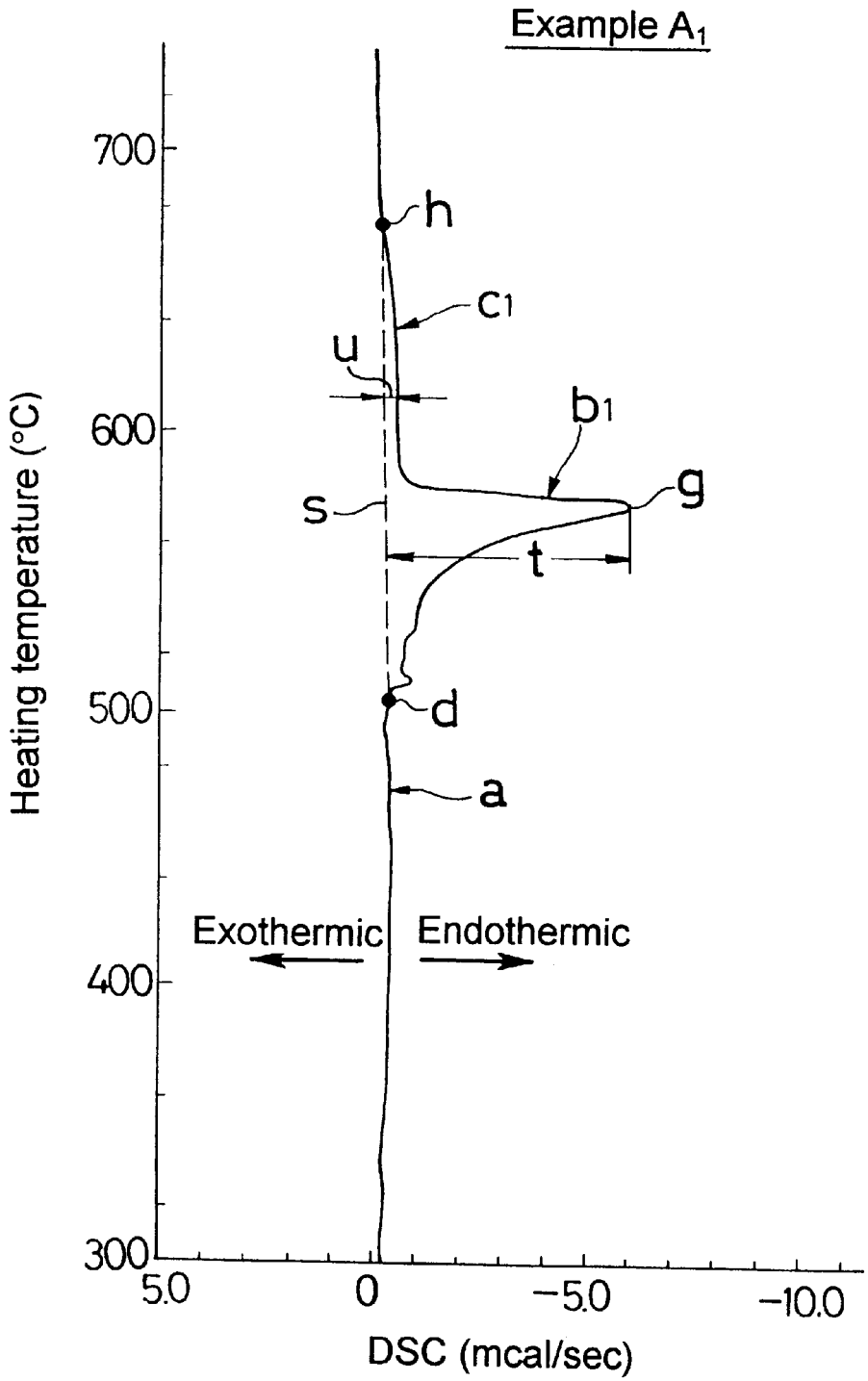
FIG. 28 is a differential calorimetric curve for the example $A_1$ of the aluminum alloy material.
Figure 29:
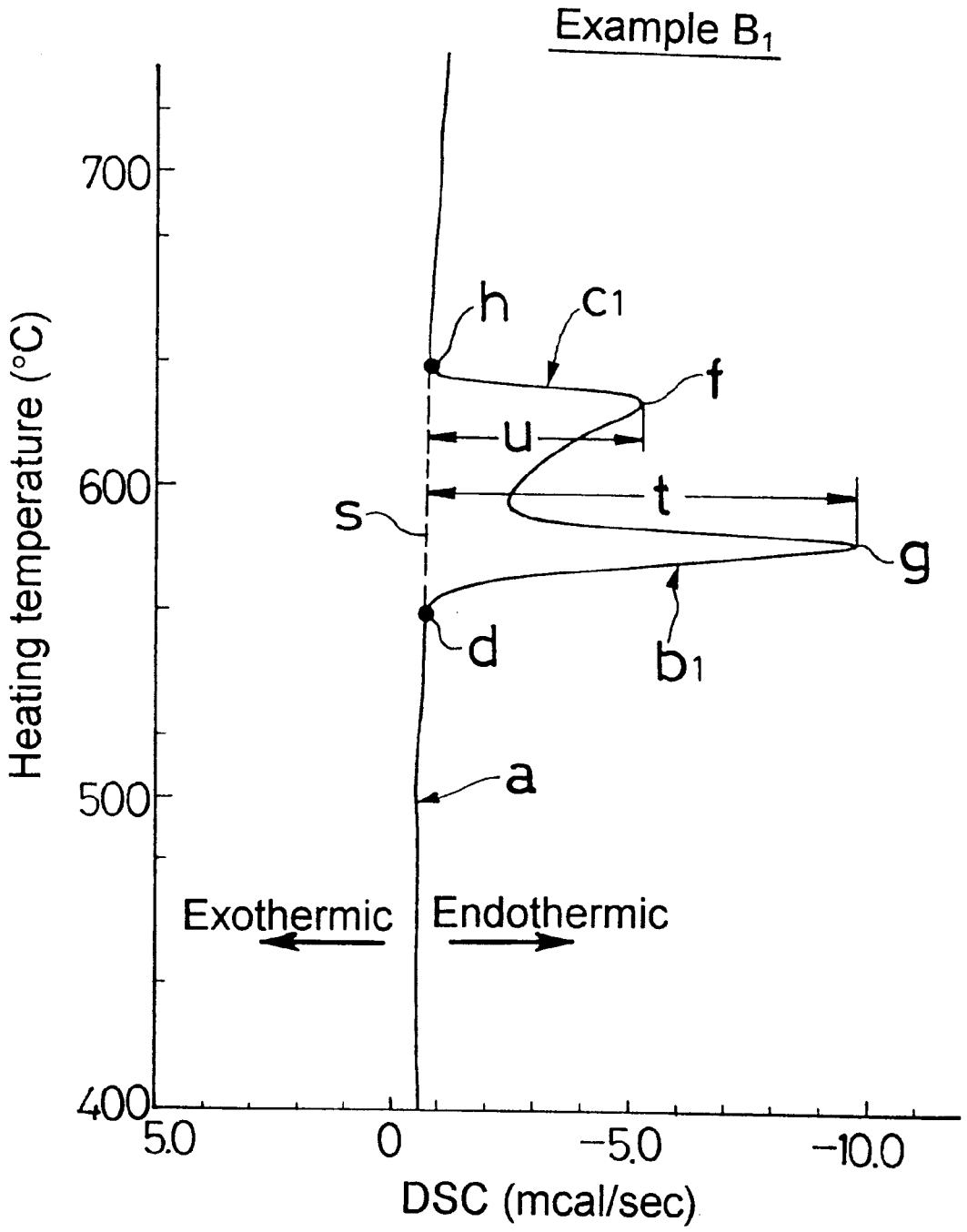
FIG. 29 is a differential calorimetric curve for an example $B_1$ of an aluminum alloy material.
Figure 30:
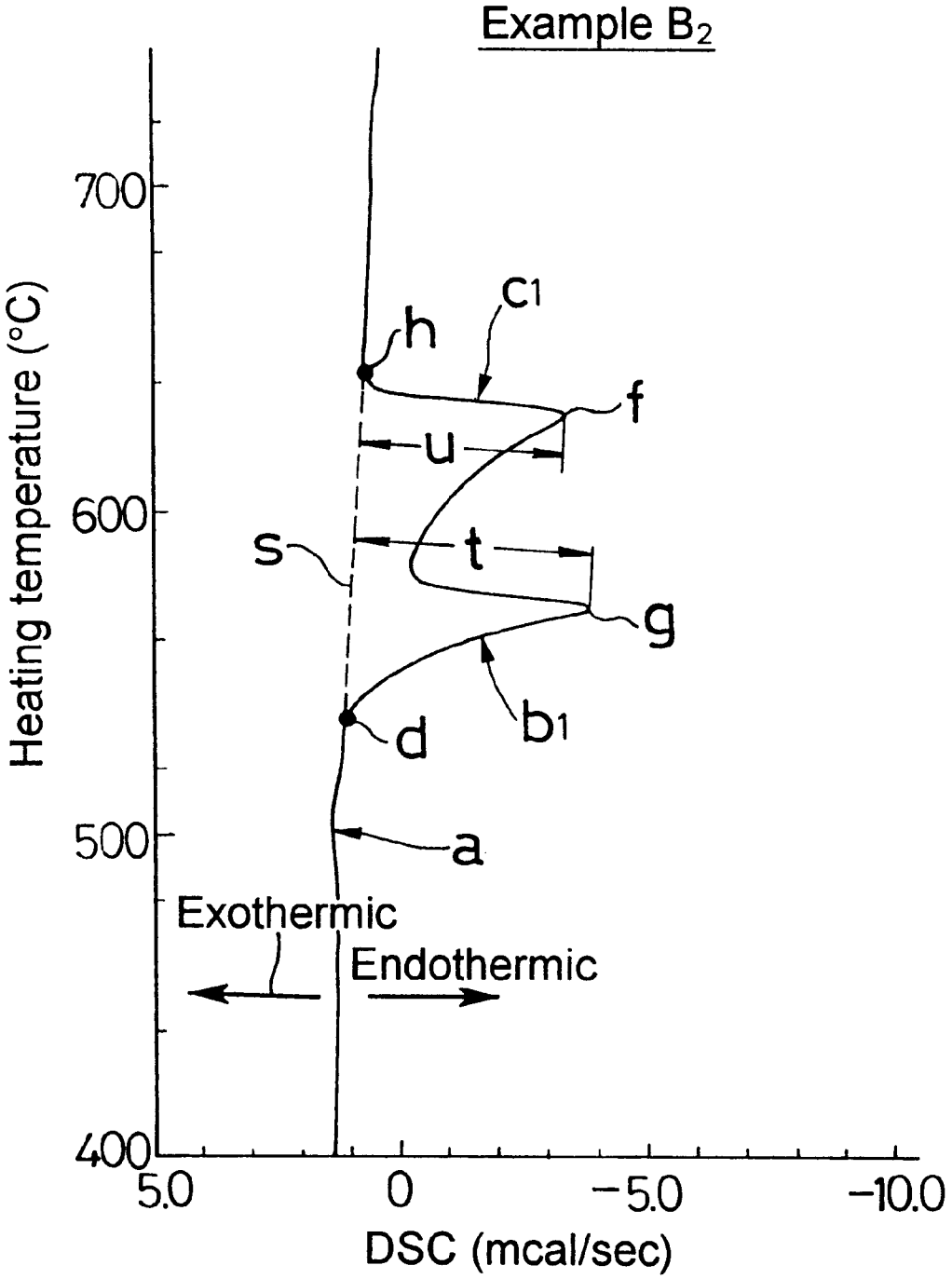
FIG. 30 is a differential calorimetric curve for an example $B_2$ of an aluminum alloy material.
Figure 31:
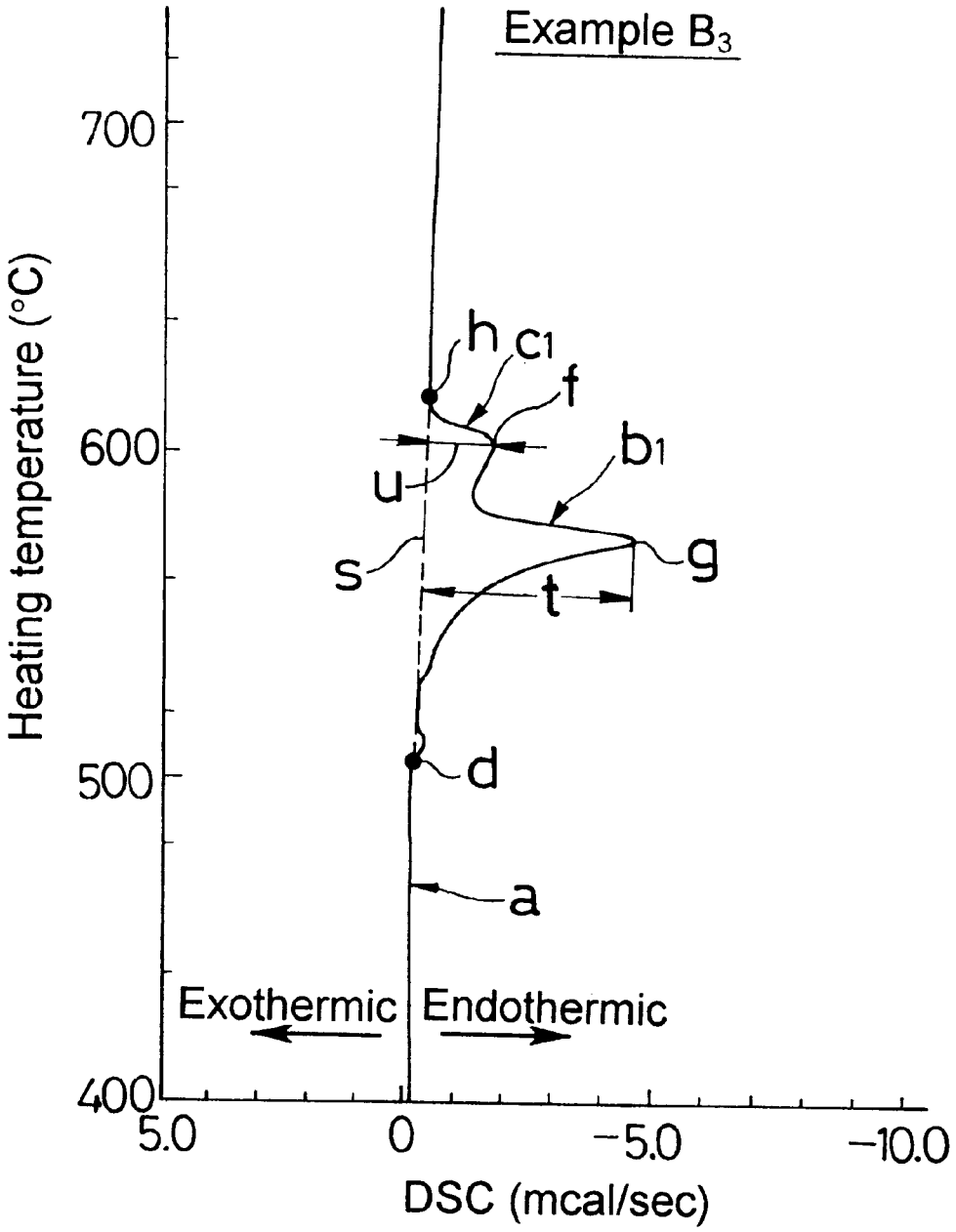
FIG. 31 is a differential calorimetric curve for an example $B_3$ of an aluminum alloy material.
Figure 32:
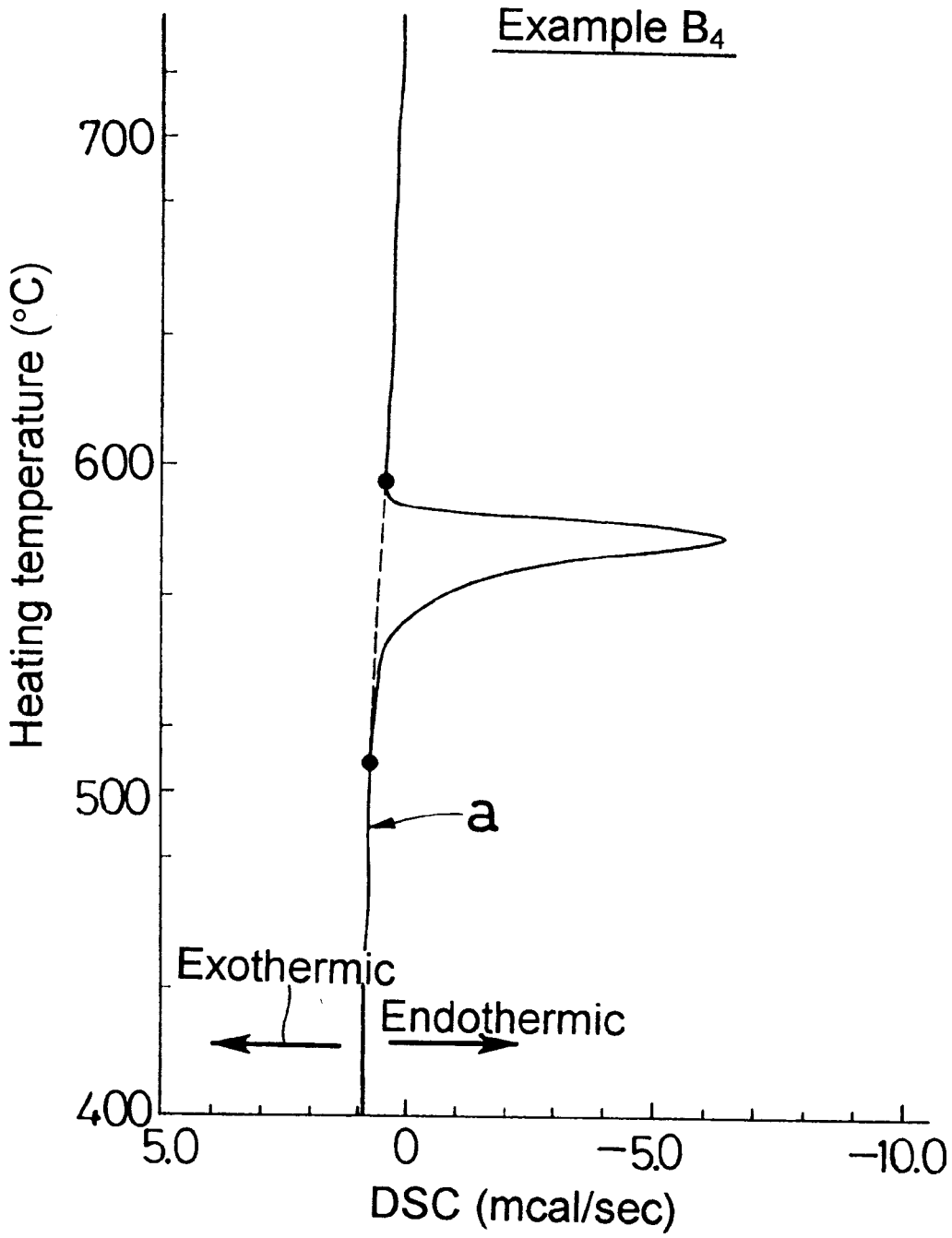
FIG. 32 is a differential calorimetric curve for an example $B_4$ of an aluminum alloy material.

The example $A_1$ was subjected to a differential scanning calorimetry (DSC) to provide a result shown in FIG. 28. A first endothermic section $b_1$ appearing due to the melting of a eutectic component, i.e., an Al-Si eutectic crystal and a second endothermic section $c_1$ appearing due to the melting of a primary crystal Si exist in a differential calorimetric curve a shown in FIG. 28. In this case, the first endothermic section $b_1$ forms an angled shape having a peak g remarkably spaced apart from a straight line s connecting a melt-start point (a rise-start point) d of the eutectic component and a melt-end point (a drop-end point) h of the high-melting component. On the other hand, the second endothermic section has a flatness extending along the straight line s.

FIGS. 29 to 32 show differential calorimetric curves for the examples $B_1$, $B_2$, $B_3$ and $B_4$. Each of the first and second endothermic sections $b_1$ and $c_1$ in the examples $B_1$, $B_2$ and $B_3$ forms an angled shape having a peak g, f, respectively. In this case, the eutectic crystal is an Al-Si eutectic crystal, and the high-melting component is α-Al. In the example $B_4$, only a single endothermic section of an angled shape exists, because the example $B_4$ is a eutectic alloy.

Then, when the maximum value of the distance between the straight line s and the first endothermic section $b_1$ in the differential calorimetric curve a for each of the examples $A_1$, $A_2$, $B_1$, $B_2$, $B_3$ and $B_4$ is represented by t, and the maximum value of the distance between the straight line s and the second endothermic section $c_1$ is represented by u, the ratio u/t of the maximum value u to the maximum value t is determined. Each of the examples $A_1$ and the like was subjected to a fluidity test. The pressure casting machine 1 shown in FIG. 8 and including the movable die $\mathbf{3}_1$ was used for the fluidity test, as in Example 2 in Embodiment I.

In the fluidity test, the example $A_1$ having a diameter of 50 mm and a length of 65 mm was first placed into the heating coil in the induction heating device and heated under conditions of a frequency of 1 kHz and a maximum output power of 30 kW to prepare an example $A_1$ of a semi-molten aluminum alloy material having solid and liquid phases. In this case, the solid phase rate was set at 50%.

Then, as shown in FIG. 8, the example $A_1$ of the semi-molten aluminum alloy material 5 was placed into the chamber 6 and forced through the gate 7 into the cavity 4 while being pressed under conditions of a casting temperature of the example $A_1$ of 572° C., a moving speed of the pressing plunger 9 of 0.20 m/sec and a mold temperature of 250° C., so that it was solidified under such a pressure.

After opening of the mold, the weight of the solidified portion located in the bent portion 4*b* of the cavity 4 was measured and defined as a flow length of the example $A_1$.

Each of the examples $A_2$, $B_1$, $B_2$, $B_3$ and $B_4$ was subjected to a similar fluidity test to measure a flow length. In the case of the example $B_4$, it is difficult for the example $B_4$ to be brought into a semi-molten state, because it is a eutectic alloy. Therefore, the measurement of the flow length of the example $B_4$ was carried out in a molten state. This example $B_4$ is unsuitable as a thixocasting alloy material.

Table 13 shows the ratio u/t and the flow length ratio for the examples $A_1$ and the like. Each of the flow length ratios was determined based on the flow length of the example $B_1$ defined as "1.0".

TABLE 13

| Example of Al alloy material | Ratio u/t | Flow length ratio |
|---|---|---|
| $A_1$ | 0.05 | 1.7 |
| $A_2$ | 0.1 | 1.6 |
| $B_1$ | 0.5 | 1.0 |
| $B_2$ | 0.8 | 0.85 |
| $B_3$ | 0.3 | 1.2 |
| $B_4$ | 0 | 1.5 |

As is apparent from Table 13, it can be seen that the examples $A_1$ and $A_2$ having the ratio $u/t \leqq 0.1$ are good in fluidity in their semi-molten states, as compared with the examples $B_1$, $B_2$, $B_3$ and $B_4$ having the ratio $u/t > 0.1$. From this fact, it is preferable that the first endothermic section $b_1$ is of an angled shape, while the second endothermic section $c_1$ has a flatness extending along the straight line s. To provide such a differential calorimetric curve a, it is preferable that 13 to 90% by weight of Si is contained as an alloy element in the aluminum alloy material. If the Si content departs from this range, a differential calorimetric curve as described above does not appear.

Then, using the pressure casting machine 1 shown in FIG. 1 and the examples $A_1$ and $B_1$, the casting operation was carried out under the same conditions as in the above-described fluidity test to produce an aluminum alloy cast product example $A_1$ corresponding to the example $A_1$ and an aluminum alloy cast product example $B_1$ corresponding to the example $B_1$.

Figure 33A:
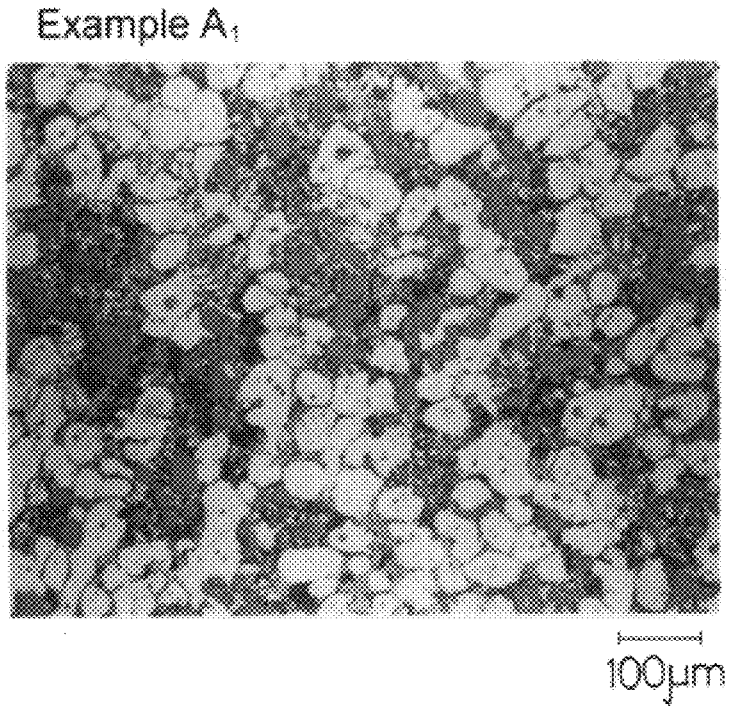
FIG. 33A is a photomicrograph showing the metallographic structure of the example $A_1$ of the aluminum alloy cast product.
Figure 33B:
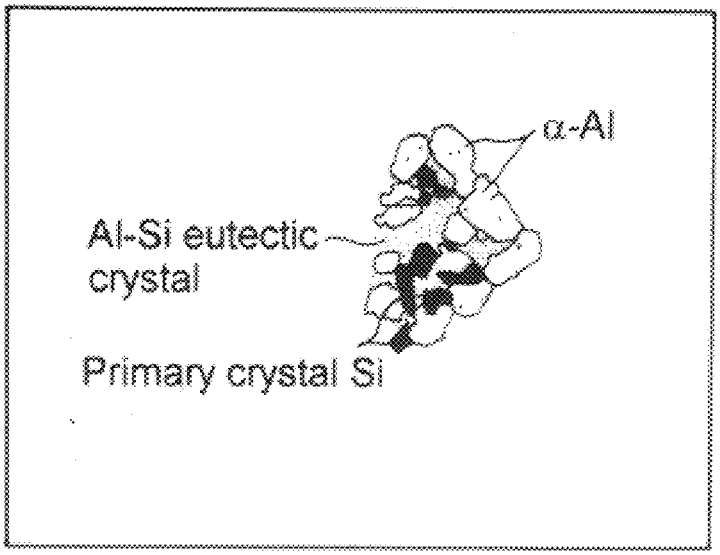
FIG. 33B is a tracing of an essential portion of FIG. 33A.

FIG. 33A is a photomicrograph showing the metallographic structure of the aluminum alloy cast product example $A_1$, and FIG. 33B is a tracing of an essential portion of FIG. 33A. It can be seen from FIGS. 33A and 33B that the aluminum alloy cast product example $A_1$ has no casting defects produced therein such as a cold shut and is sound. This is attributable to the fact that the fluidity of the example $A_1$ in the semi-molten state is good.

Figure 34:
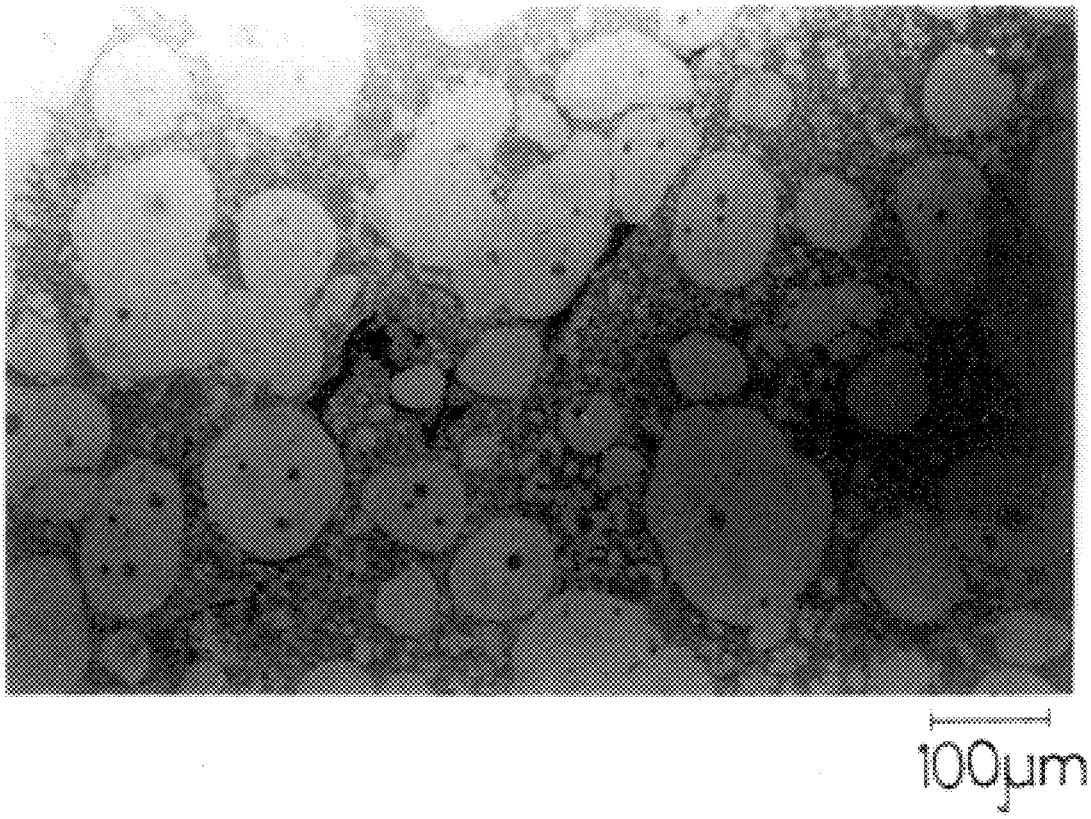
FIG. 34 is a photomicrograph showing the metallographic structure of the example $B_1$ of the aluminum alloy cast product.

FIG. 34 is a photomicrograph showing the metallographic structure of the aluminum alloy cast product example $B_1$. It can be seen from FIG. 34 that cold shuts shown as darkened black areas, were produced in the matrix and between the matrix and the spherical α-Al in the aluminum alloy cast product example $B_1$. This is attributable to the fact that the fluidity of the example $B_1$ in the semi-molten state is poor. In this case, the matrix is comprised of an Al-Si eutectic crystal (a dark gray portion) and the α-Al (a light gray portion).

What is claimed is:

1. A thixocasting process comprising the steps of:

subjecting an aluminum alloy material containing Sr added thereto as an agent for enhancing a red-heated degree of the aluminum alloy material during heating, to a heating treatment to prepare a semi-molten aluminum alloy material having solid and liquid phases coexisting therein;

forcing said semi-molten aluminum alloy material into a cavity in a casting mold under pressure; and solidifying said semi-molten aluminum alloy material under pressure, wherein an amount of Sr added in said aluminum alloy material is set in a range of $0 \text{ ppm} < Sr < 100 \text{ ppm}$, and a shear rate Rs of said semi-molten aluminum alloy material in the cavity is set in a range of $Rs \geqq 50\ S^{-1}$.

2. A thixocasting process according to claim 1, wherein said aluminum alloy material has a hypo eutectic crystal composition and a characteristic that a first angled endothermic section appearing due to the melting of a eutectic crystal and a second angled endothermic section appearing due to the melting of a component having a melting point higher than a eutectic point coexist in a differential calorimetric curve, and wherein the temperature of a rise-start point in said first angled endothermic section is represented by $T_1$, the temperature of a drop-end point in said first angled endothermic section is represented by $T_2$, and a casting temperature of said semi-molten aluminum alloy material is set in a range of $T_1 \leqq T \leqq T_2$.

3. A thixocasting process according to claim 1, wherein a solid phase amount S of the volume fraction of solid phases in the total volume of said semi-molten aluminum alloy material is set in a range of $S \geqq 10\%$ at said casting temperature.

4. A thixocasting process according to claim 1, wherein said aluminum alloy material includes a $Mg_2Si$ content in a range of 2% by weight $\leqq Mg_2Si \leqq$ 11% by weight.

5. A thixocasting process according to claim 2, wherein said aluminum alloy material includes a $Mg_2Si$ content in a range of 2% by weight $\leqq Mg_2Si \leqq$ 11% by weight.

6. A thixocasting process according to claim 3, wherein said aluminum alloy material includes a $Mg_2Si$ content in a range of 2% by weight $\leqq Mg_2Si \leqq$ 11% by weight.

7. A thixocasting process according to claim 1, wherein a solid phase amount S of the volume fraction of solid phases in the total volume of said semi-molten aluminum alloy material is set in a range of $S \geqq 10\%$ at a casting temperature of said semi-molten aluminum alloy material.

* * * * *